US009289890B2

(12) United States Patent
Ludy et al.

(10) Patent No.: US 9,289,890 B2
(45) Date of Patent: Mar. 22, 2016

(54) ROTARY HAMMER

(71) Applicant: Milwaukee Electric Tool Corporation, Brookfield, WI (US)

(72) Inventors: Benjamin Ludy, Milwaukee, WI (US); Andrew J. Weber, Cudahy, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 134 days.

(21) Appl. No.: 14/150,711

(22) Filed: Jan. 8, 2014

(65) Prior Publication Data

US 2014/0116739 A1 May 1, 2014

Related U.S. Application Data

(62) Division of application No. 13/326,525, filed on Dec. 15, 2011, now Pat. No. 8,636,081.

(51) Int. Cl.

| | |
|---|---|
| ***B25D 11/04*** | (2006.01) |
| ***B25D 16/00*** | (2006.01) |
| ***B25D 11/00*** | (2006.01) |

(52) U.S. Cl.

CPC ..... *B25D 11/04* (2013.01); *B25D 11/005* (2013.01); *B25D 16/00* (2013.01); *B25D 2211/068* (2013.01); *B25D 2216/0023* (2013.01); *B25D 2216/0038* (2013.01); *B25D 2217/0015* (2013.01); *B25D 2250/131* (2013.01); *B25D 2250/191* (2013.01); *B25D 2250/345* (2013.01)

(58) Field of Classification Search

CPC ..... B25D 11/04; B25D 16/00
USPC ..... 173/128, 48, 204
See application file for complete search history.

(56) References Cited

U.S. PATENT DOCUMENTS

| | | | |
|---|---|---|---|
| 3,835,715 | A | 9/1974 | Howell |
| 3,929,195 | A | 12/1975 | Stiltz et al. |

(Continued)

FOREIGN PATENT DOCUMENTS

| | | |
|---|---|---|
| GB | 1512214 | 5/1978 |
| GB | 2147240 | 5/1985 |
| WO | 03/024671 | 3/2003 |

OTHER PUBLICATIONS

DeWalt D25012K—Parts list for DeWalt model No. D25012K rotary hammer, www.dewaltservicenet.com, 5 pages, 2005.

(Continued)

*Primary Examiner* — Michelle Lopez
(74) *Attorney, Agent, or Firm* — Michael Best & Friedrich LLP

(57) ABSTRACT

A rotary hammer includes a motor, a spindle coupled to the motor for receiving torque from the motor, a piston at least partially received within the spindle for reciprocation therein, a striker received within the spindle for reciprocation in response to reciprocation of the piston, and an anvil received within the spindle and positioned between the striker and a tool bit. The rotary hammer also includes a retainer received within the spindle for selectively securing the striker in an idle position in which it is inhibited from reciprocating within the spindle, and an O-ring positioned between the retainer and the spindle. The O-ring is disposed around an outer peripheral surface of the anvil. The O-ring is compressible in response to the striker assuming the idle position. The compressed O-ring imparts a frictional force on the outer peripheral surface of the anvil to decelerate the anvil.

11 Claims, 29 Drawing Sheets

(56) References Cited

U.S. PATENT DOCUMENTS

| | | | |
|---|---|---|---|
| 4,064,949 | A | 12/1977 | Chromy |
| 4,299,294 | A | 11/1981 | Womack |
| 4,332,340 | A | 6/1982 | Harris |
| 4,431,062 | A | 2/1984 | Wanner et al. |
| 4,446,931 | A | 5/1984 | Bleicher et al. |
| 4,529,044 | A | 7/1985 | Klueber et al. |
| 4,612,999 | A | 9/1986 | Bergler |
| 4,719,976 | A | 1/1988 | Bleicher et al. |
| 4,732,217 | A | 3/1988 | Bleicher et al. |
| 5,036,925 | A | 8/1991 | Wache |
| 5,036,926 | A | 8/1991 | Cavedo |
| 5,052,498 | A | 10/1991 | Gustafsson et al. |
| 5,088,566 | A | 2/1992 | Gustafsson et al. |
| 5,099,926 | A | 3/1992 | Fushiya et al. |
| 5,125,461 | A | 6/1992 | Höser |
| 5,159,986 | A | 11/1992 | Höser |
| 5,226,487 | A | 7/1993 | Spektor |
| 5,277,259 | A | 1/1994 | Schmid et al. |
| 5,320,177 | A | 6/1994 | Shibata et al. |
| 5,379,848 | A | 1/1995 | Rauser |
| 5,435,397 | A | 7/1995 | Demuth |
| 5,449,043 | A | 9/1995 | Bourner et al. |
| 5,588,496 | A | 12/1996 | Elger |
| 5,664,634 | A | 9/1997 | McCracken |
| 5,732,782 | A | 3/1998 | Fünfer |
| 5,775,440 | A | 7/1998 | Shinma |
| 5,787,996 | A | 8/1998 | Fünfer |
| 5,793,134 | A | 8/1998 | Worm |
| 5,871,059 | A | 2/1999 | Shibata et al. |
| 5,873,418 | A | 2/1999 | Arakawa et al. |
| 5,954,140 | A | 9/1999 | Bauer |
| 5,975,217 | A | 11/1999 | Frenzel et al. |
| 5,996,708 | A | 12/1999 | Gerold |
| 6,035,945 | A | 3/2000 | Ichijyou et al. |
| 6,076,436 | A | 6/2000 | Farley et al. |
| 6,109,364 | A | 8/2000 | Demuth et al. |
| 6,112,830 | A | 9/2000 | Ziegler et al. |
| 6,116,352 | A | 9/2000 | Frauhammer et al. |
| 6,192,996 | B1 | 2/2001 | Sakaguchi et al. |
| 6,223,833 | B1 | 5/2001 | Thurler et al. |
| 6,237,700 | B1 | 5/2001 | Berger et al. |
| 6,431,290 | B1 | 8/2002 | Muhr et al. |
| 6,460,627 | B1 | 10/2002 | Below et al. |
| 6,523,622 | B1 | 2/2003 | Berger et al. |
| 6,527,280 | B2 | 3/2003 | Frauhammer et al. |
| 6,550,546 | B2 | 4/2003 | Thurler et al. |
| 6,557,648 | B2 | 5/2003 | Ichijyou et al. |
| 6,568,484 | B1 | 5/2003 | Schmid et al. |
| 6,666,284 | B2 | 12/2003 | Stirm |
| 6,688,406 | B1 | 2/2004 | Wu et al. |
| 6,691,796 | B1 | 2/2004 | Wu |
| 6,732,815 | B2 | 5/2004 | Hanke et al. |
| 6,733,414 | B2 | 5/2004 | Elger |
| 6,874,585 | B2 | 4/2005 | Zhao |
| 6,913,089 | B2 | 7/2005 | Stirm |
| 6,913,090 | B2 | 7/2005 | Droste et al. |
| 6,932,166 | B1 | 8/2005 | Kirsch |
| 6,938,704 | B2 | 9/2005 | Berger et al. |
| 6,948,571 | B2 | 9/2005 | Hanke et al. |
| 6,955,230 | B2 | 10/2005 | Meixner |
| 6,971,455 | B2 | 12/2005 | Shibata et al. |
| 6,997,269 | B1 | 2/2006 | Putney et al. |
| 7,021,401 | B2 | 4/2006 | Droste et al. |
| 7,032,683 | B2 | 4/2006 | Hetcher et al. |
| 7,032,688 | B2 | 4/2006 | Kirsch |
| 7,036,607 | B2 | 5/2006 | Lebisch et al. |
| 7,070,008 | B2 | 7/2006 | Baumann et al. |
| 7,174,969 | B2 | 2/2007 | Droste |
| 7,287,600 | B2 | 10/2007 | Braun |
| 7,296,635 | B2 | 11/2007 | Droste |
| 7,306,048 | B2 | 12/2007 | Yamazaki |
| 7,325,624 | B2 | 2/2008 | Yamazaki |
| 7,395,872 | B2 | 7/2008 | Dusselberg et al. |
| 7,398,835 | B2 | 7/2008 | Stirm |
| 7,404,450 | B2 | 7/2008 | Izumisawa et al. |
| 7,404,451 | B2 | 7/2008 | Neumann |
| 7,455,121 | B2 | 11/2008 | Saito et al. |
| 7,469,752 | B2 | 12/2008 | Furusawa et al. |
| RE40,643 | E | 2/2009 | Stirm |
| 7,521,831 | B2 | 4/2009 | Smirnov et al. |
| 7,591,324 | B2 | 9/2009 | Saur |
| 7,635,032 | B2 | 12/2009 | Saur et al. |
| 7,726,414 | B2 | 6/2010 | Berger et al. |
| 7,743,846 | B2 | 6/2010 | Gensmann et al. |
| 7,753,135 | B2 | 7/2010 | Lennartz |
| 7,802,711 | B2 | 9/2010 | Fuenfer |
| 7,818,880 | B2 | 10/2010 | Heep et al. |
| 7,857,074 | B2 | 12/2010 | Meixner |
| 8,011,442 | B2 | 9/2011 | Lennartz |
| 8,636,081 | B2 | 1/2014 | Ludy et al. |
| 2002/0050367 | A1 | 5/2002 | Manschitz |
| 2006/0124333 | A1 | 6/2006 | Berger |
| 2007/0034398 | A1 | 2/2007 | Murakami et al. |
| 2007/0215369 | A1 | 9/2007 | Stark et al. |
| 2008/0164042 | A1 | 7/2008 | Mascall |
| 2008/0169111 | A1 | 7/2008 | Duesselberg et al. |
| 2008/0217039 | A1 | 9/2008 | Fuenfer et al. |
| 2008/0217040 | A1 | 9/2008 | Loeffler et al. |
| 2009/0032305 | A1 | 2/2009 | Weddfelt |
| 2009/0065226 | A1 | 3/2009 | John et al. |
| 2009/0126959 | A1 | 5/2009 | Stark et al. |
| 2009/0145618 | A1 | 6/2009 | Duesselberg et al. |
| 2009/0159304 | A1 | 6/2009 | Teranishi et al. |
| 2009/0223692 | A1 | 9/2009 | Yoshikane |
| 2009/0260842 | A1 | 10/2009 | Randa |
| 2009/0308626 | A1 | 12/2009 | Saur |
| 2009/0321101 | A1 | 12/2009 | Furusawa et al. |
| 2010/0000748 | A1 | 1/2010 | Machida et al. |
| 2010/0051303 | A1 | 3/2010 | Ullrich et al. |
| 2010/0101814 | A1 | 4/2010 | Bernhardt et al. |
| 2010/0236804 | A1 | 9/2010 | Kriedel et al. |
| 2010/0270046 | A1 | 10/2010 | Schlesak et al. |
| 2010/0300715 | A1 | 12/2010 | Storm et al. |
| 2010/0300717 | A1 | 12/2010 | Baumann et al. |
| 2011/0005791 | A1 | 1/2011 | Baumann et al. |
| 2011/0017483 | A1 | 1/2011 | Baumann et al. |

OTHER PUBLICATIONS

DCH213L2—Parts list for DeWalt model No. DCH213L2 rotary hammer, www.dewaltservicenet.com, 5 pages, 2005.

International Search Report and Written Opinion for Application No. PCT/US2011/065757 dated Nov. 14, 2012 (7 pages).

ROTARY HAMMER

CROSS-REFERENCE TO RELATED APPLICATIONS

This application is a divisional of U.S. patent application Ser. No. 13/326,525 filed on Dec. 15, 2011, now U.S. Pat. No. 8,636,081, the entire content of which is incorporated herein by reference.

FIELD OF THE INVENTION

The present invention relates to power tools, and more particularly to rotary hammers

BACKGROUND OF THE INVENTION

Rotary hammers typically include a rotatable spindle, a reciprocating piston within the spindle, and a striker that is selectively reciprocable within the piston in response to an air pocket developed between the piston and the striker. Rotary hammers also typically include an anvil that is impacted by the striker when the striker reciprocates within the piston. The impact between the striker and the anvil is transferred to a tool bit, causing it to reciprocate for performing work on a work piece.

SUMMARY OF THE INVENTION

The invention provides, in one aspect, a rotary hammer adapted to impart axial impacts to a tool bit. The rotary hammer includes a motor, a spindle coupled to the motor for receiving torque from the motor, a piston at least partially received within the spindle for reciprocation therein, a striker received within the spindle for reciprocation in response to reciprocation of the piston, and an anvil received within the spindle and positioned between the striker and the tool bit. The anvil imparts axial impacts to the tool bit in response to reciprocation of the striker. The rotary hammer also includes a retainer received within the spindle for selectively securing the striker in an idle position in which it is inhibited from reciprocating within the spindle, and an O-ring positioned between the retainer and the spindle. The O-ring is disposed around an outer peripheral surface of the anvil. The O-ring is compressible in response to the striker assuming the idle position. An inner diameter of the O-ring is reduced in response to being compressed. The compressed O-ring imparts a frictional force on the outer peripheral surface of the anvil to decelerate the anvil.

The invention provides, in another aspect, a rotary hammer including a motor, a spindle coupled to the motor for receiving torque from the motor, a radial bearing that rotatably supports the spindle, a front gear case in which the spindle is at least partially received, a rear gear case coupled to the front gear case, a bearing holder axially constraining the radial bearing against one of the front gear case and the rear gear case, and an internal locating surface defined on the other of the front gear case and the rear gear case to which the bearing holder and the one of the front gear case and the rear gear case are registered.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
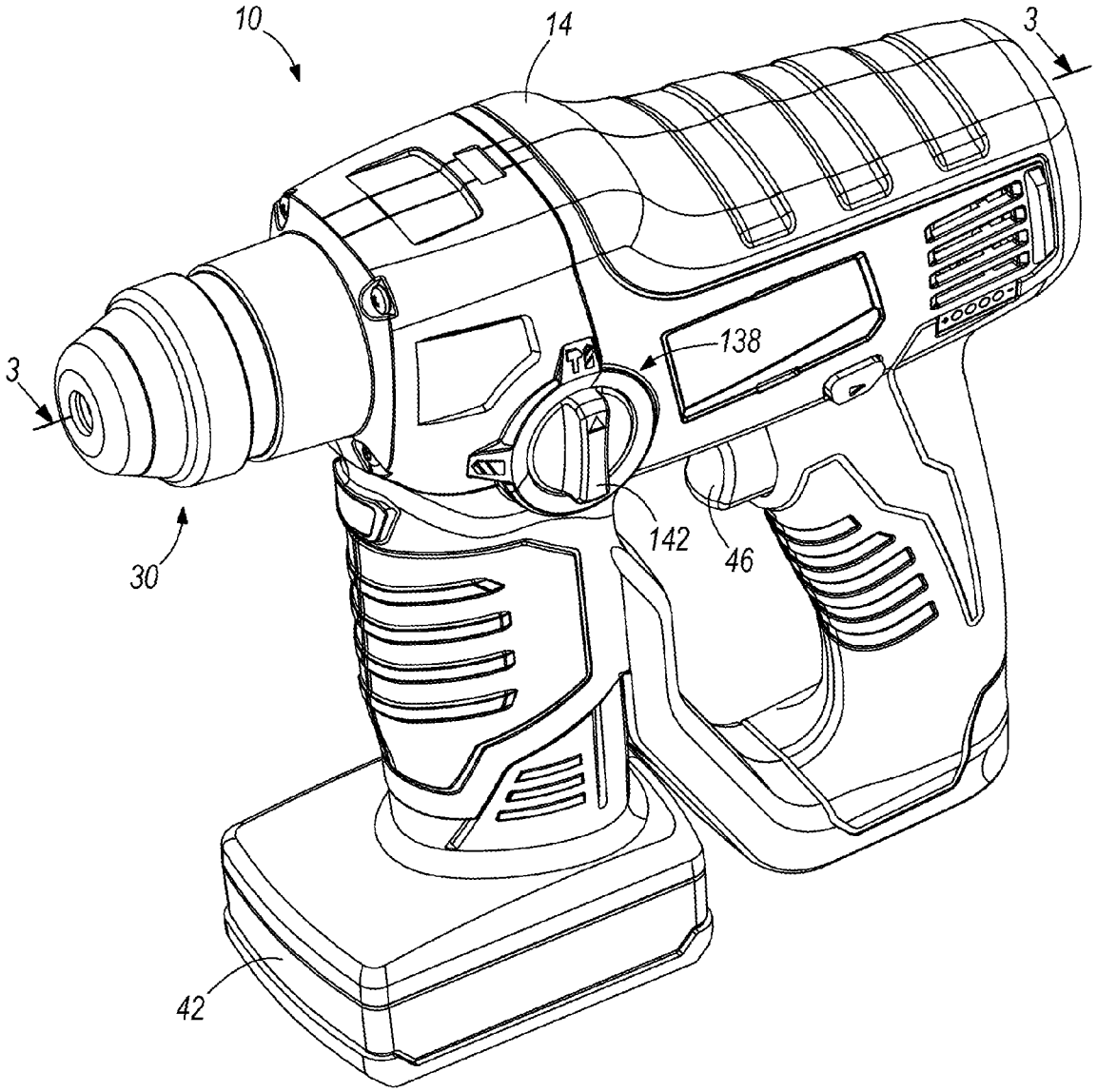
FIG. 1 is a front perspective view of a rotary hammer in accordance with an embodiment of the invention.
Figure 2:
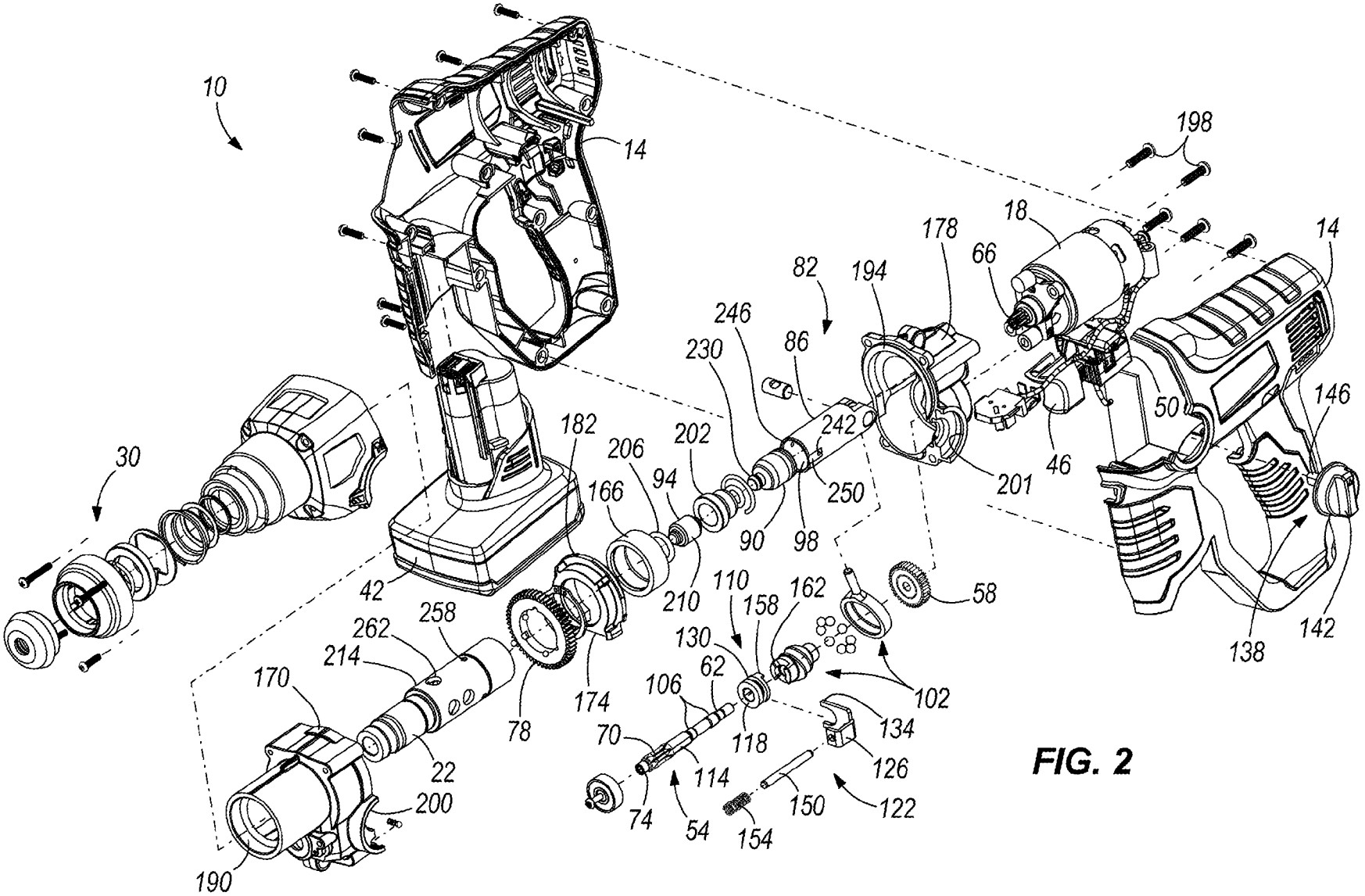
FIG. 2 is an exploded perspective view of the rotary hammer of FIG. 1.
Figure 3:
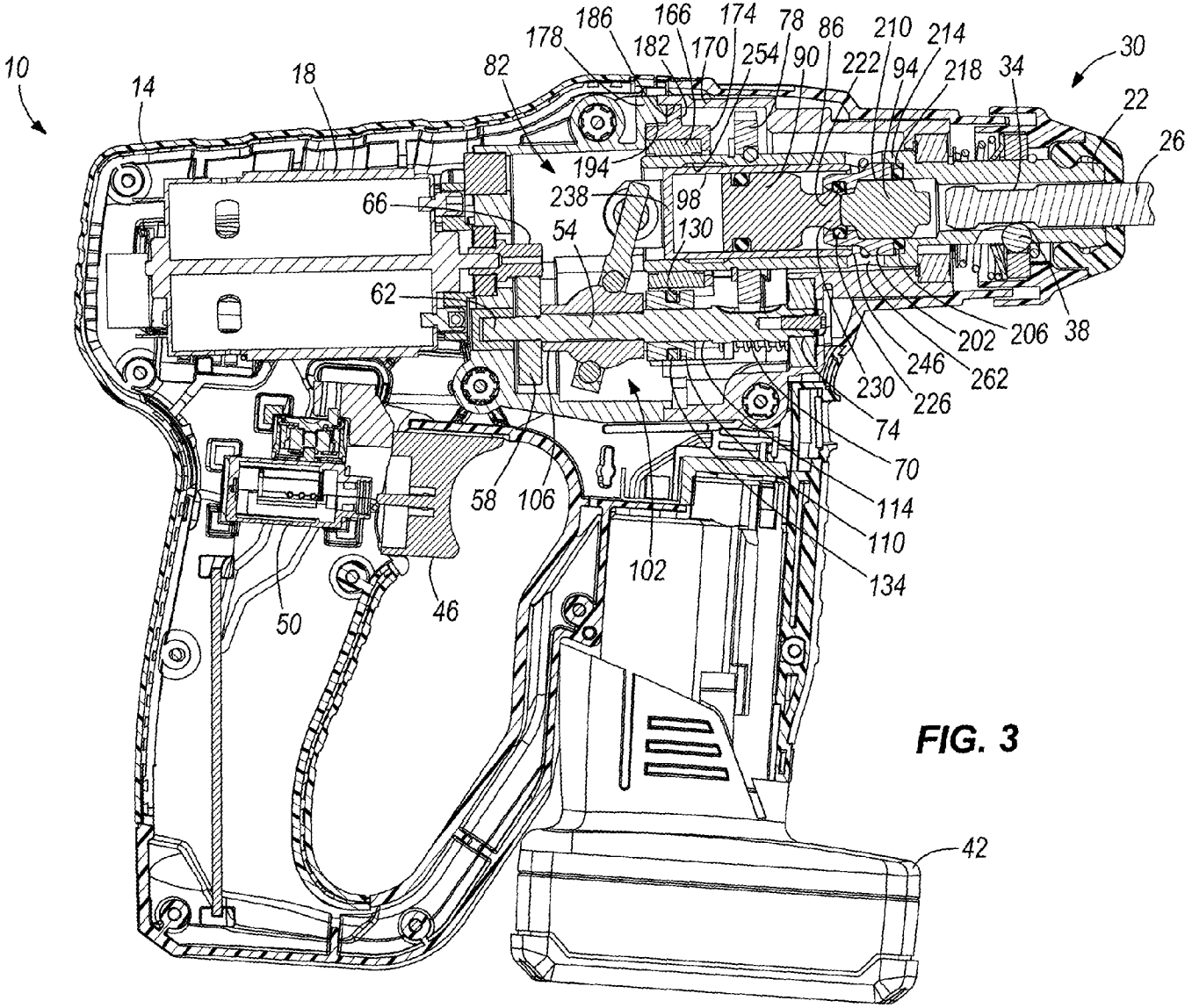
FIG. 3 is a cross-sectional view of the rotary hammer of FIG. 1 through line 3-3 in FIG. 1.

FIGS. 1-3 illustrate a rotary hammer 10 including a housing 14, a motor 18 disposed within the housing 14, and a rotatable spindle 22 coupled to the motor 18 for receiving torque from the motor 18. As shown in FIG. 3, a tool bit 26 may be secured to the spindle 22 for co-rotation with the spindle 22 (e.g., using a spline fit). In the illustrated construction, the rotary hammer 10 includes a quick-release mechanism 30 coupled for co-rotation with the spindle 22 to facilitate quick removal and replacement of different tool bits 26. With continued reference to FIG. 3, the tool bit 26 includes a necked section 34, or alternatively opposed longitudinal grooves, in which a detent member 38 of the quick-release mechanism 30 is received to constrain axial movement of the tool bit 26 to the length of the necked section 34.

In the illustrated construction of the rotary hammer 10, the motor 18 is configured as a DC motor 18 that receives power from an on-board power source (e.g., a battery 42). The battery 42 may include any of a number of different nominal voltages (e.g., 12V, 18V, etc.), and may be configured having any of a number of different chemistries (e.g., lithium-ion, nickel-cadmium, etc.). Alternatively, the motor 18 may be powered by a remote power source (e.g., a household electrical outlet) through a power cord. The motor 18 is selectively activated by depressing a trigger 46 which, in turn, actuates a switch 50 (FIGS. 2 and 3). The switch 50 may be electrically connected to the motor 18 via a top-level or master controller, or one or more circuits, for controlling operation of the motor 18.

With continued reference to FIGS. 2 and 3, the rotary hammer 10 also includes an offset intermediate shaft 54 for transferring torque from the motor 18 to the spindle 22. A driven gear 58 is attached to a first end 62 of the intermediate shaft 54 and is engaged with a pinion 66 driven by the motor 18. The intermediate shaft 54 includes a pinion 70 on a second end 74 of the intermediate shaft 54. The pinion 70 is engaged with a driven gear 78 attached to the spindle 22. The respective longitudinal axes of the motor pinion 66, the intermediate shaft 54, and the spindle 22 are non-collinear (FIG. 3).

The rotary hammer 10 further includes an impact mechanism 82 having a reciprocating piston 86 disposed within the spindle 22, a striker 90 that is selectively reciprocable within the spindle 22 in response to reciprocation of the piston 86, and an anvil 94 that is impacted by the striker 90 when the striker 90 reciprocates toward the tool bit 26. The impact between the striker 90 and the anvil 94 is transferred to the tool bit 26, causing it to reciprocate for performing work on a work piece. In the illustrated construction of the rotary hammer 10, the piston 86 is hollow and defines an interior chamber 98 in which the striker 90 is received. As will be discussed in more detail below, an air pocket is developed between the piston 86 and the striker 90 when the piston 86 reciprocates within the spindle 22, whereby expansion and contraction of the air pocket induces reciprocation of the striker 90.

With reference to FIGS. 2 and 3, the impact mechanism 82 further includes a wobble assembly 102 supported on the intermediate shaft 54 and selectively coupled for co-rotation with the intermediate shaft 54 to impart reciprocating motion to the piston 86. The wobble assembly 102 is supported on a cylindrical portion 106 of the intermediate shaft 54. The impact mechanism 82 also includes a coupler 110 supported on a non-cylindrical portion 114 of the intermediate shaft 54. The coupler 110 includes an aperture 118 having a non-cylindrical shape (e.g., a double-D shape) corresponding to the cross-sectional shape of the non-cylindrical portion 114 of the intermediate shaft 54 (FIG. 2). Accordingly, the coupler 110 co-rotates with the intermediate shaft 54 at all times.

Figure 9:
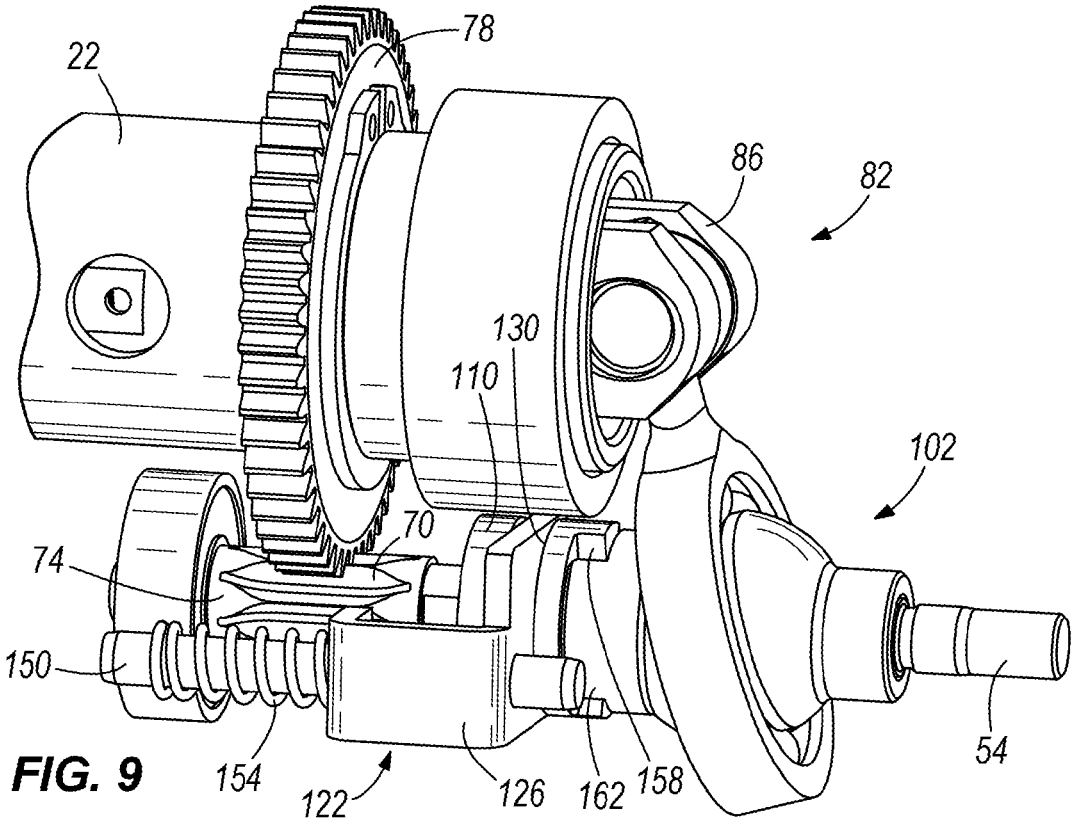
FIG. 9 is an enlarged, perspective view of a portion of the rotary hammer of FIG. 1, illustrating an impact mechanism of the rotary hammer activated.
Figure 10:
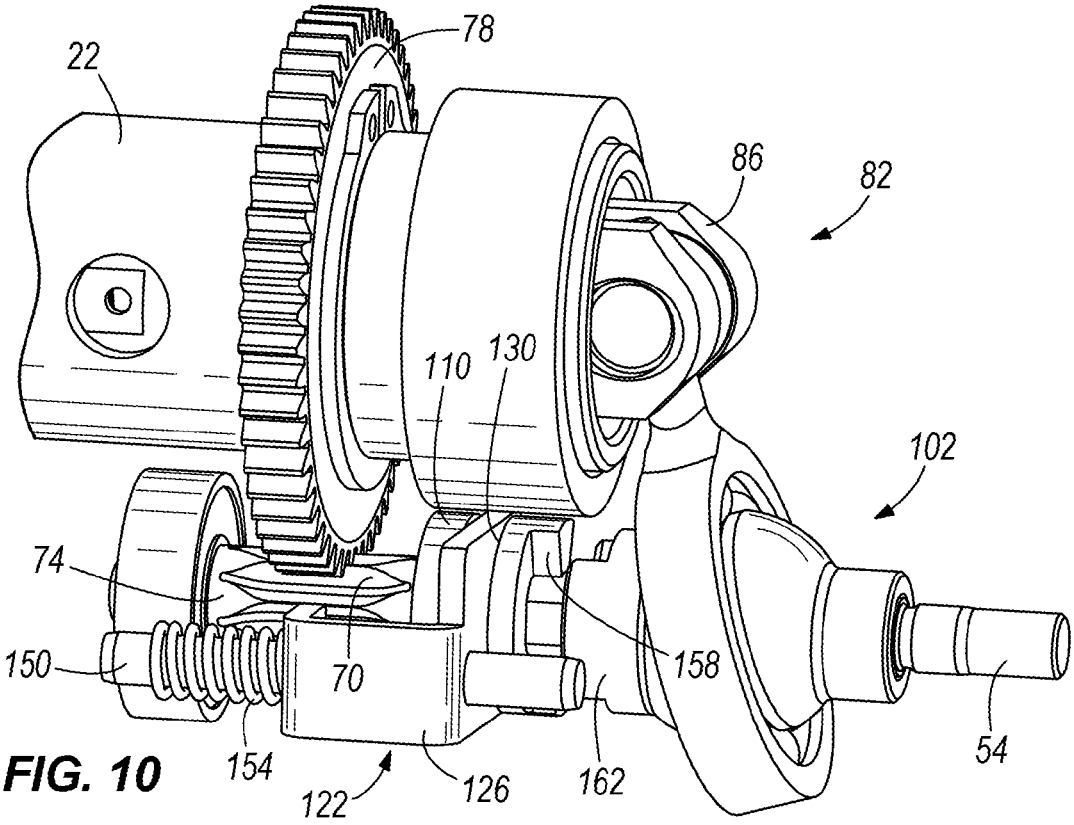
FIG. 10 is an enlarged, perspective view of a portion of the rotary hammer of FIG. 1, illustrating the impact mechanism of the rotary hammer deactivated.
Figure 11:
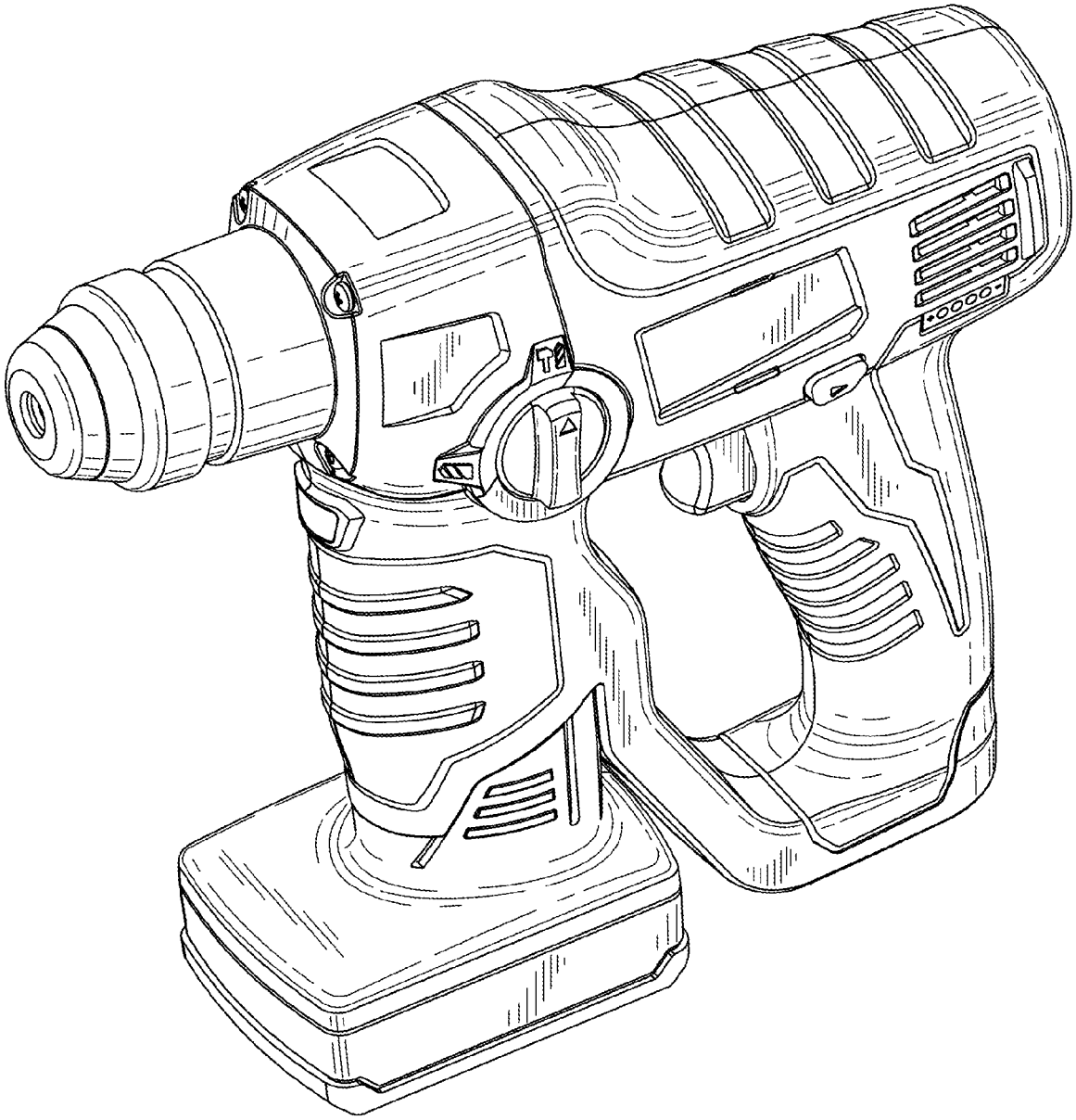
FIG. 11 is another front perspective view of the rotary hammer of FIG. 1.
Figure 12:
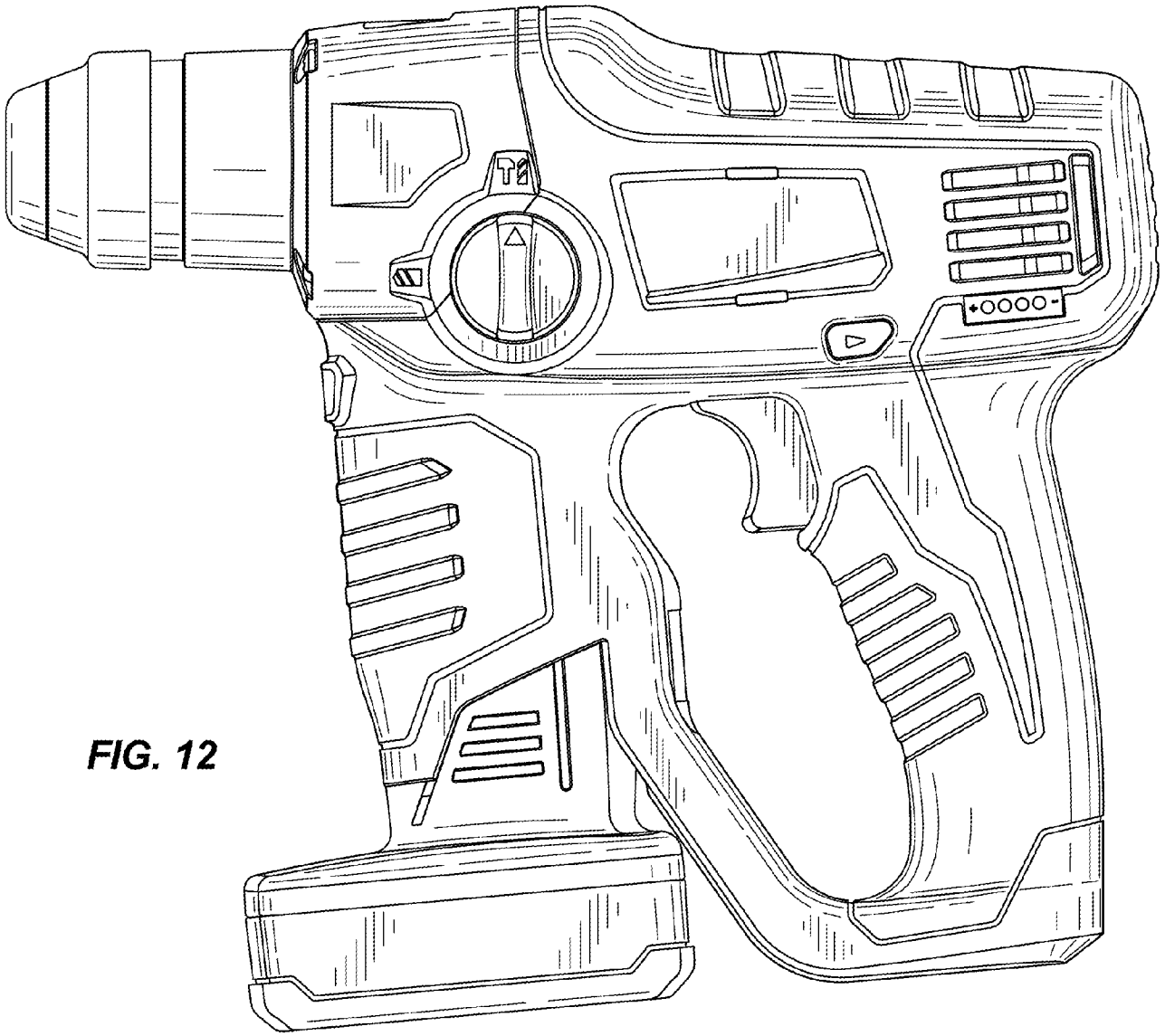
FIG. 12 is a right side view of the rotary hammer of FIG. 11.
Figure 13:
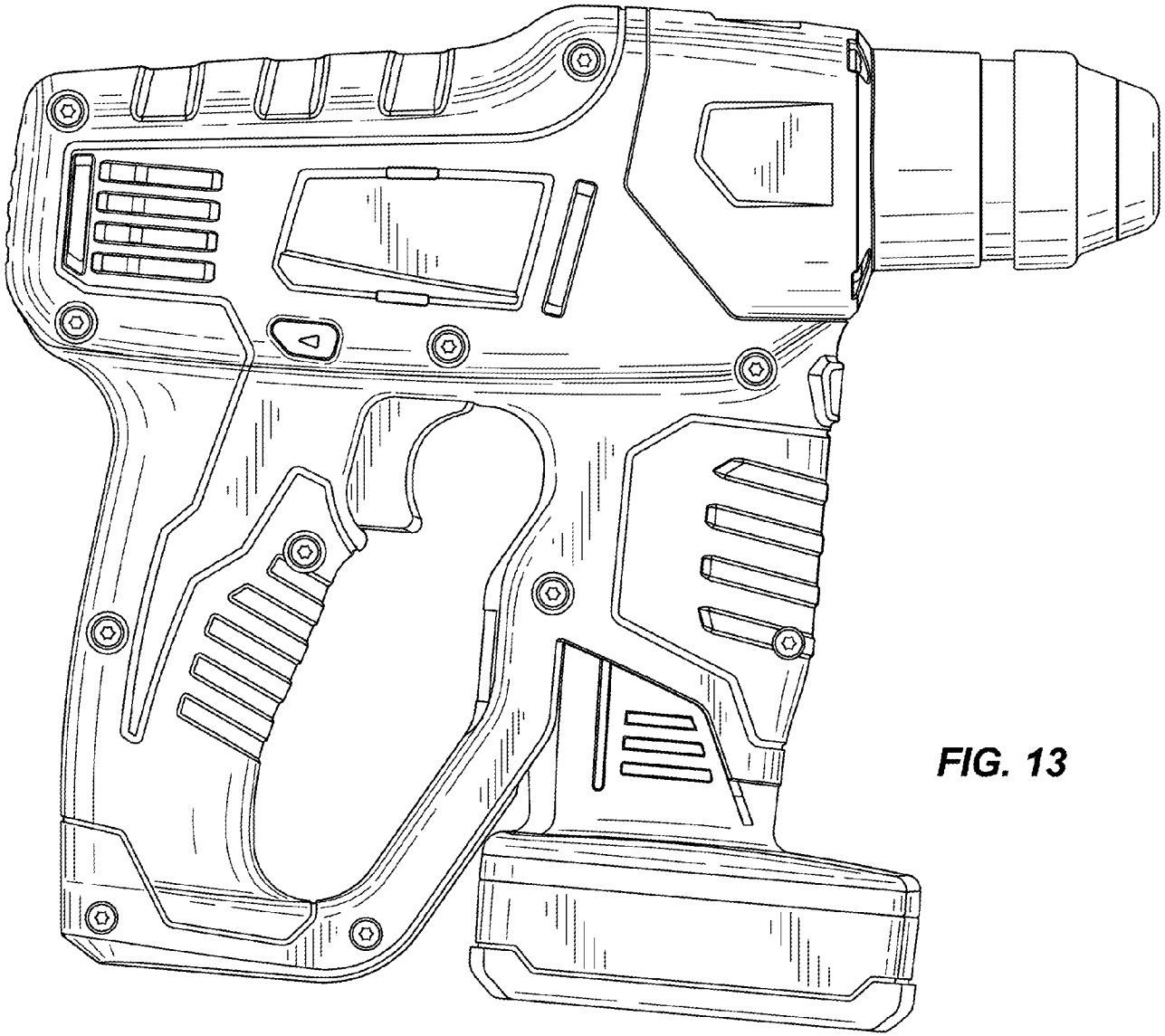
FIG. 13 is a left side view of the rotary hammer of FIG. 11.
Figure 14:
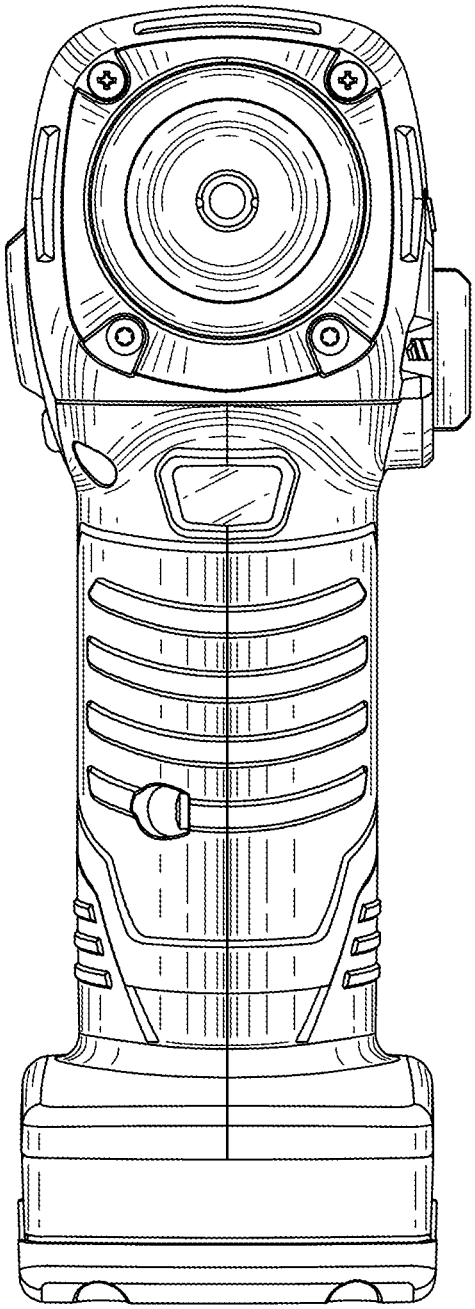
FIG. 14 is a front view of the rotary hammer of FIG. 11.
Figure 15:
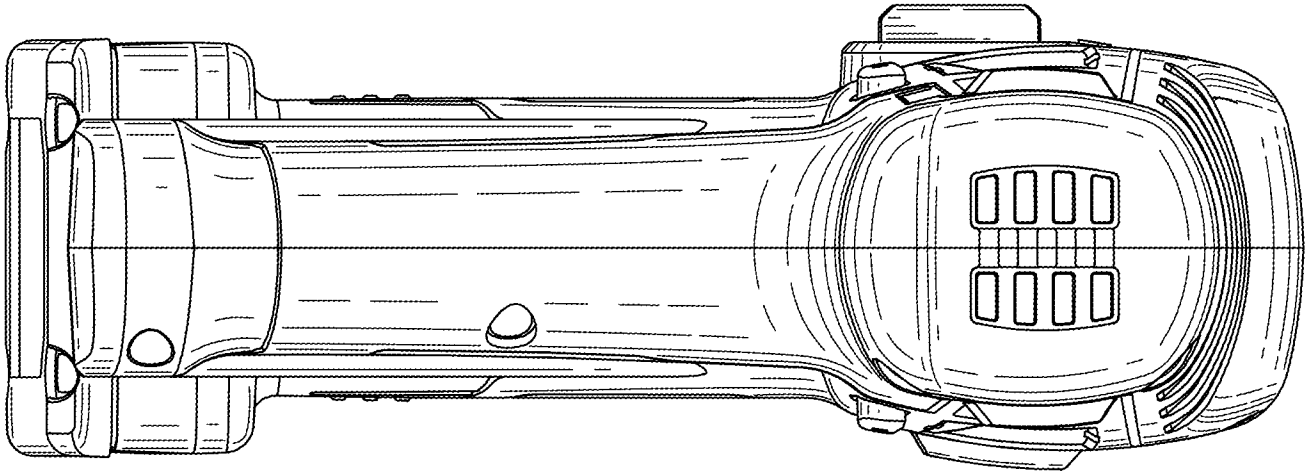
FIG. 15 is a rear view of the rotary hammer of FIG. 11.
Figure 16:
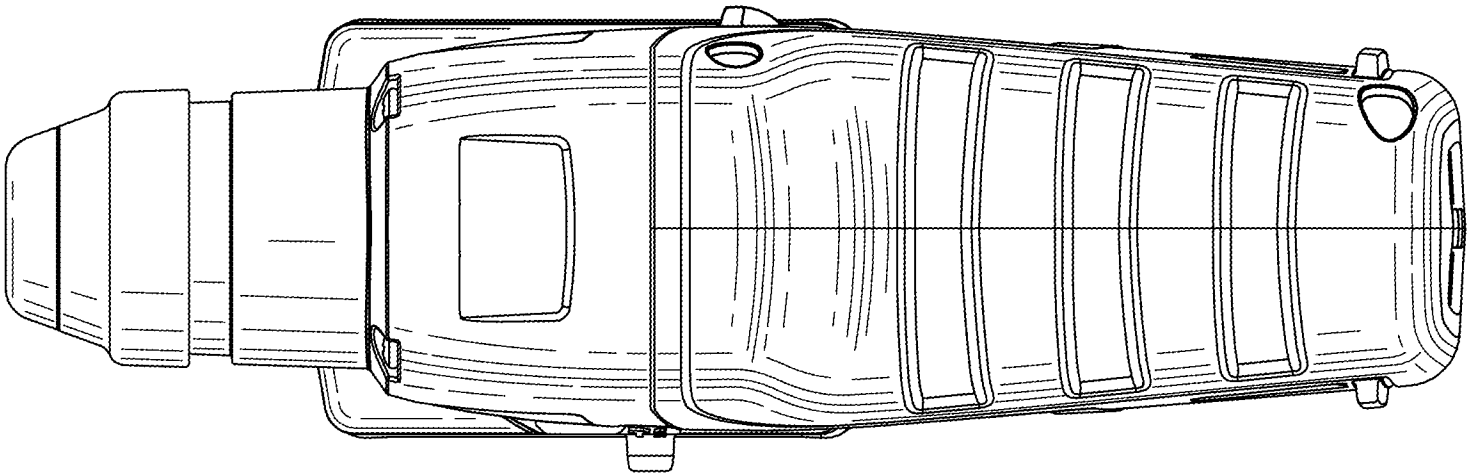
FIG. 16 is a top view of the rotary hammer of FIG. 11.
Figure 17:
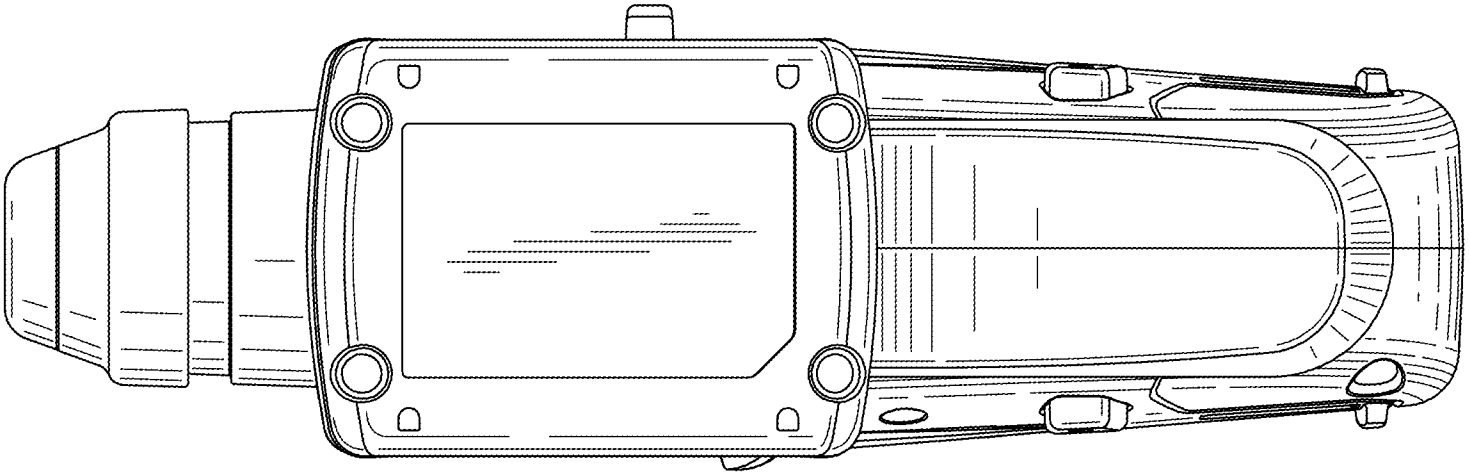
FIG. 17 is a bottom view of the rotary hammer of FIG. 11.
Figure 18:
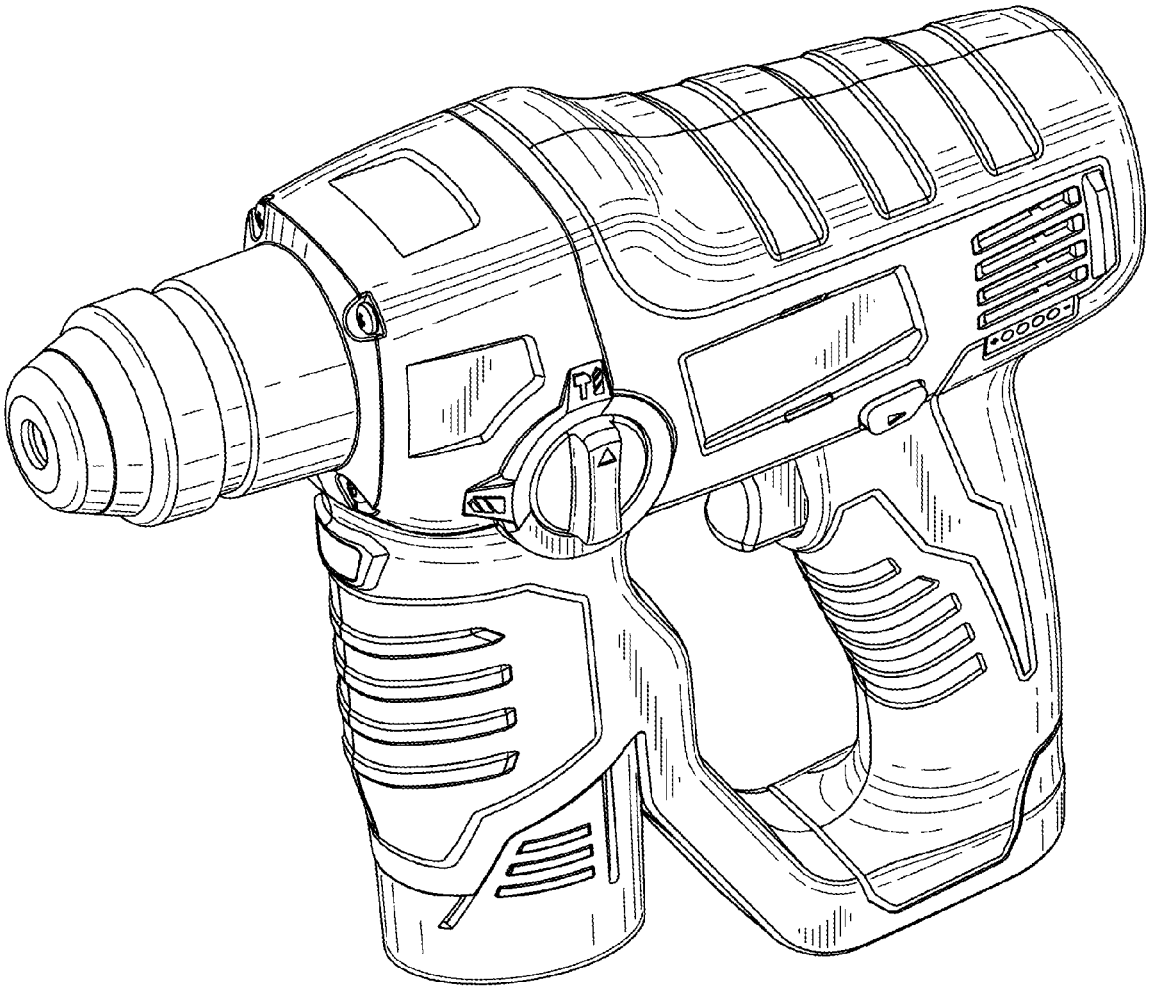
FIG. 18 is a front perspective view of a rotary hammer in accordance with another embodiment of the invention.
Figure 19:
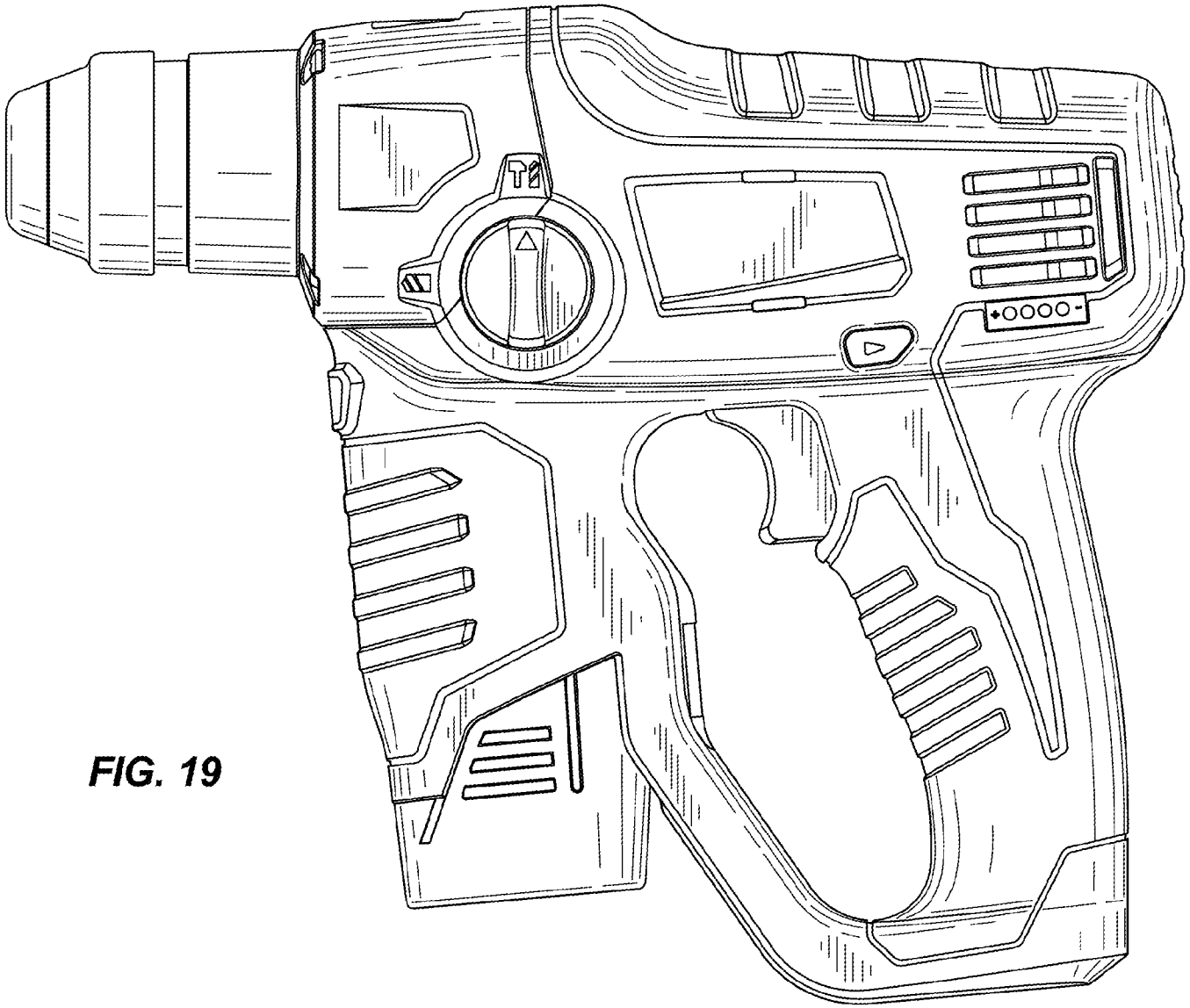
FIG. 19 is a right side view of the rotary hammer of FIG. 18.
Figure 20:
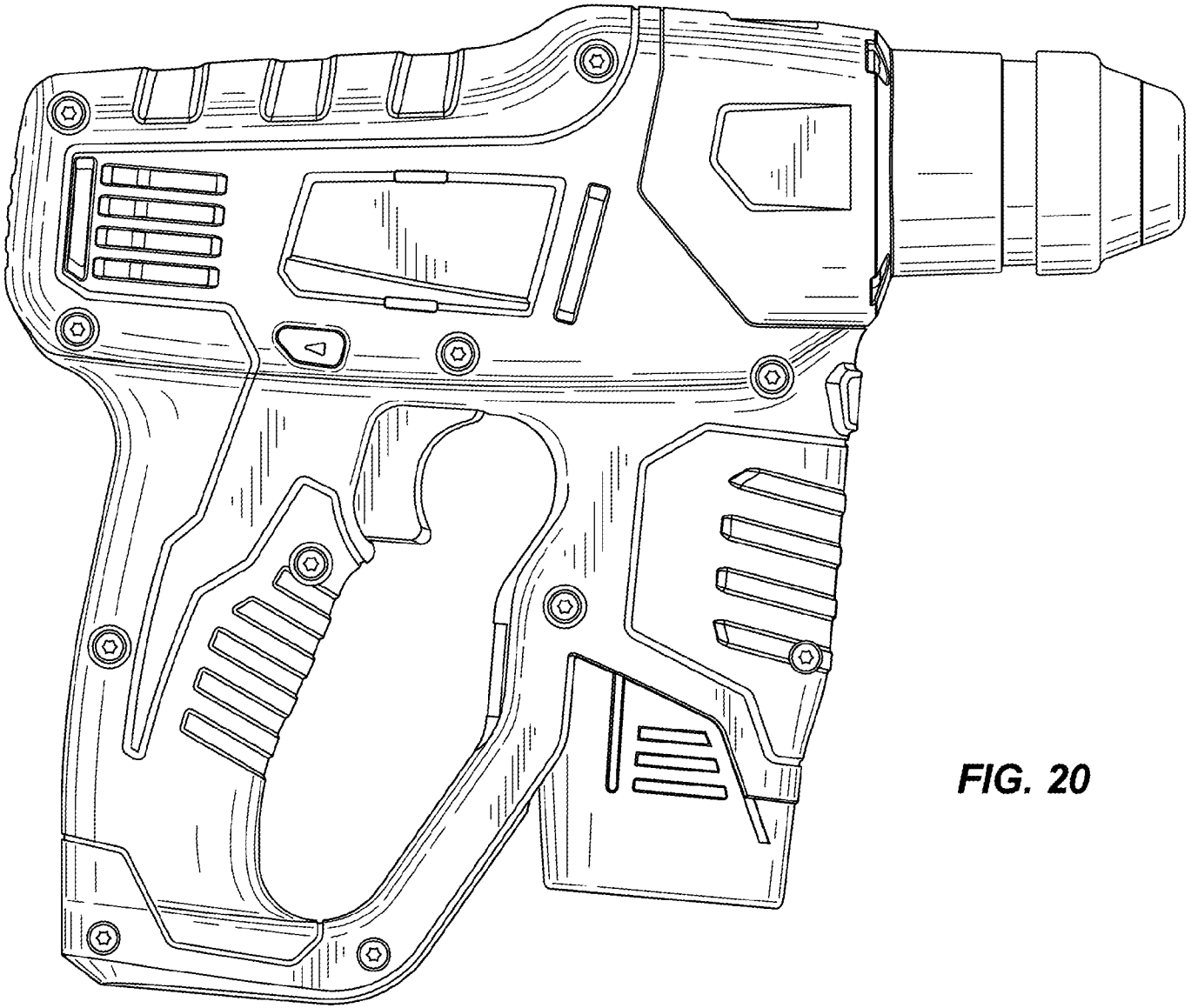
FIG. 20 is a left side view of the rotary hammer of FIG. 18.
Figure 21:
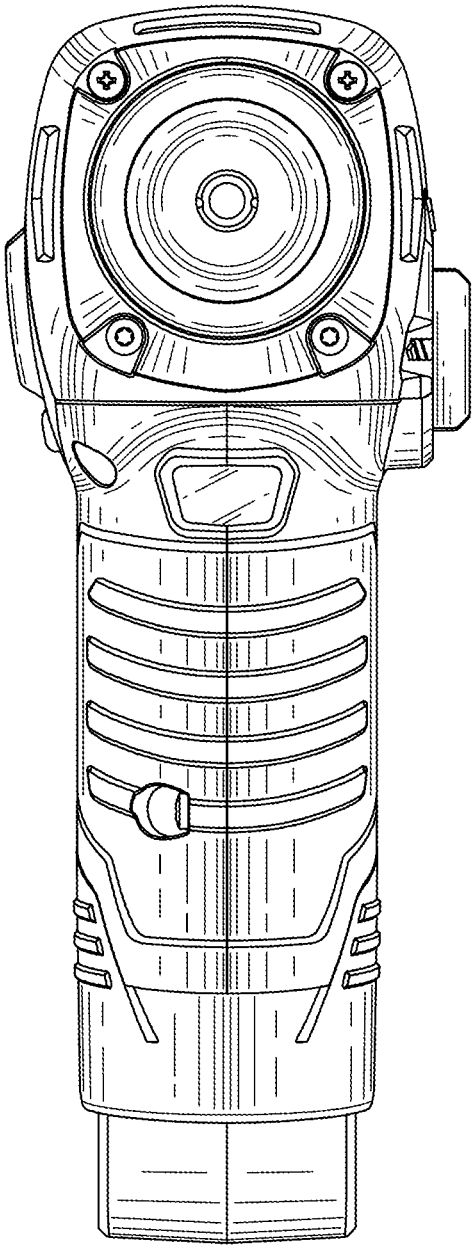
FIG. 21 is a front view of the rotary hammer of FIG. 18.
Figure 22:
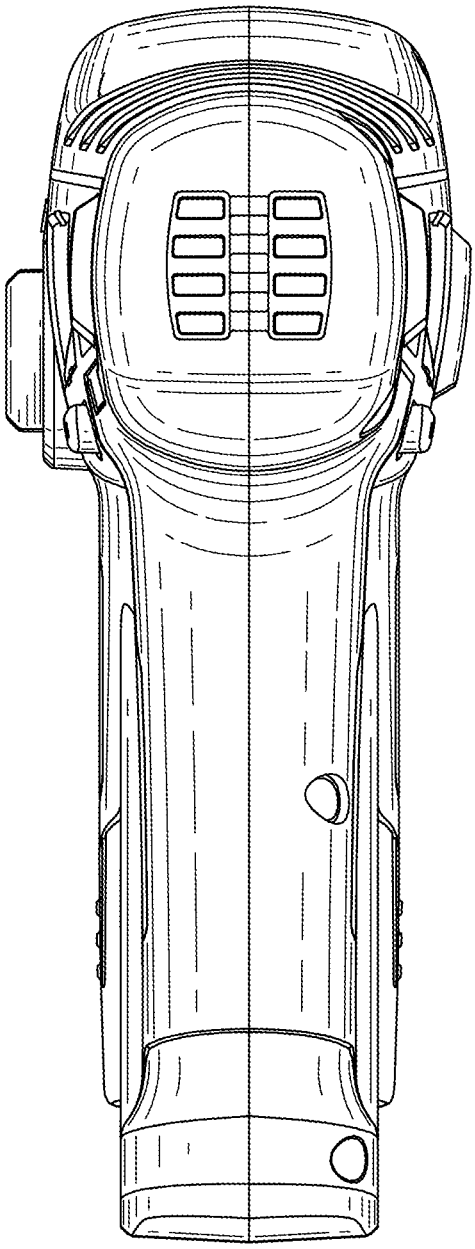
FIG. 22 is a rear view of the rotary hammer of FIG. 18.
Figure 23:
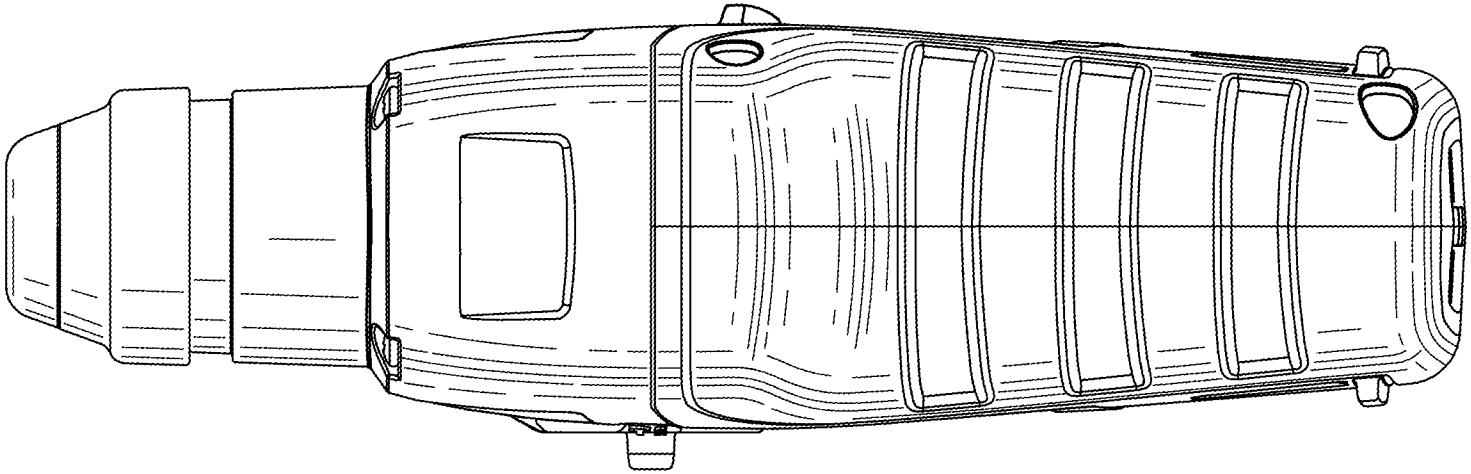
FIG. 23 is a top view of the rotary hammer of FIG. 18.
Figure 24:
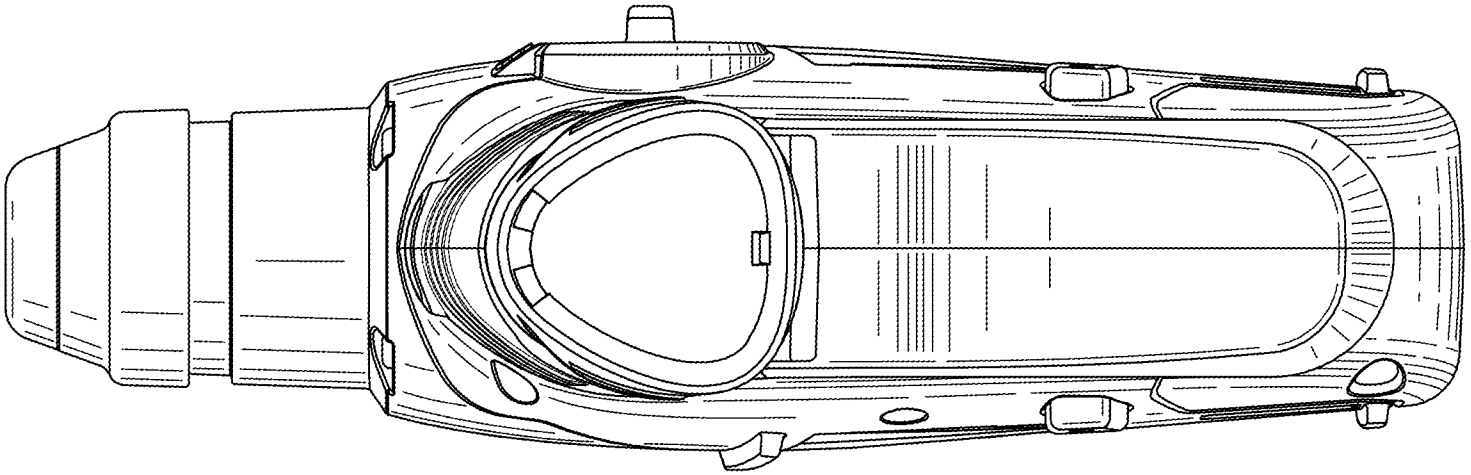
FIG. 24 is a bottom view of the rotary hammer of FIG. 18.
Figure 25:
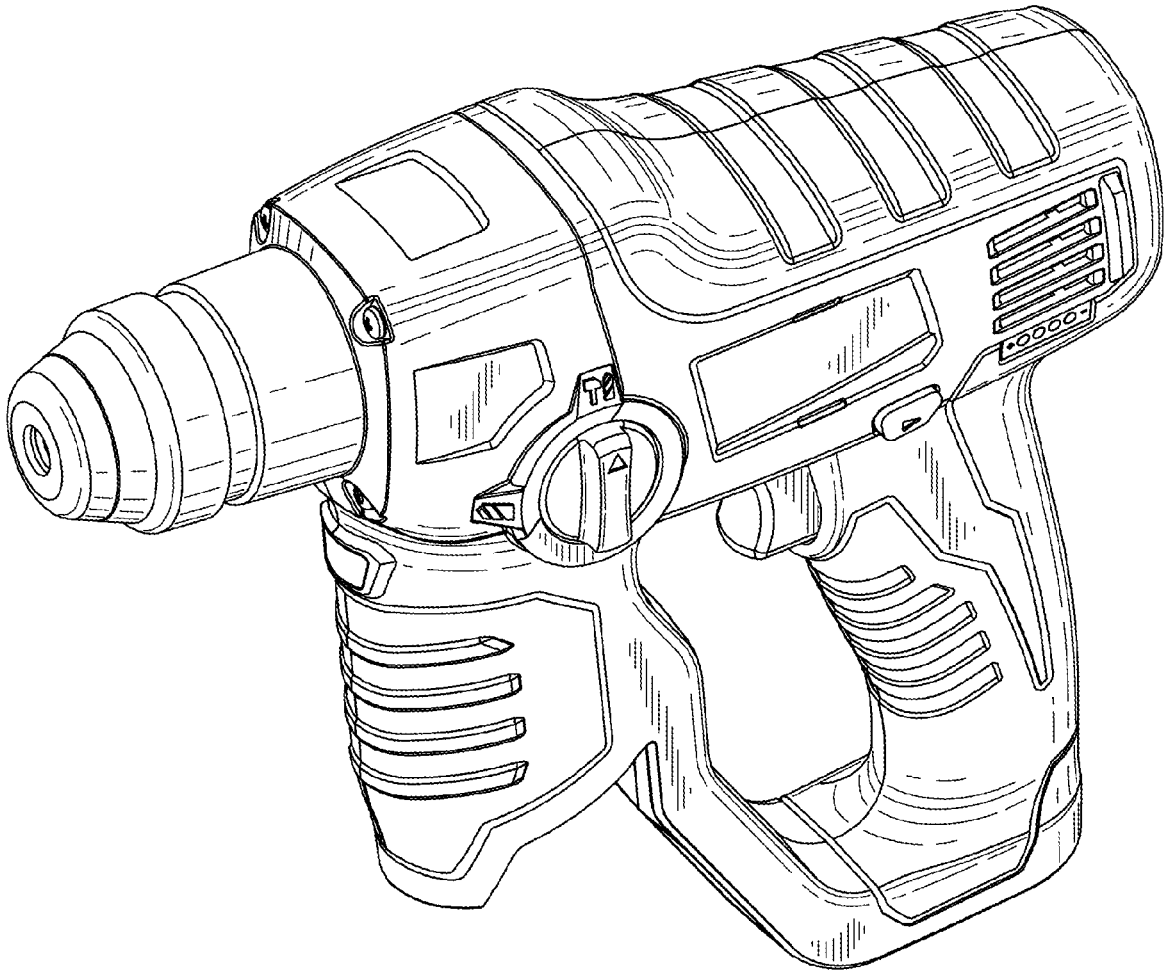
FIG. 25 is a front perspective view of a rotary hammer in accordance with yet another embodiment of the invention.
Figure 26:
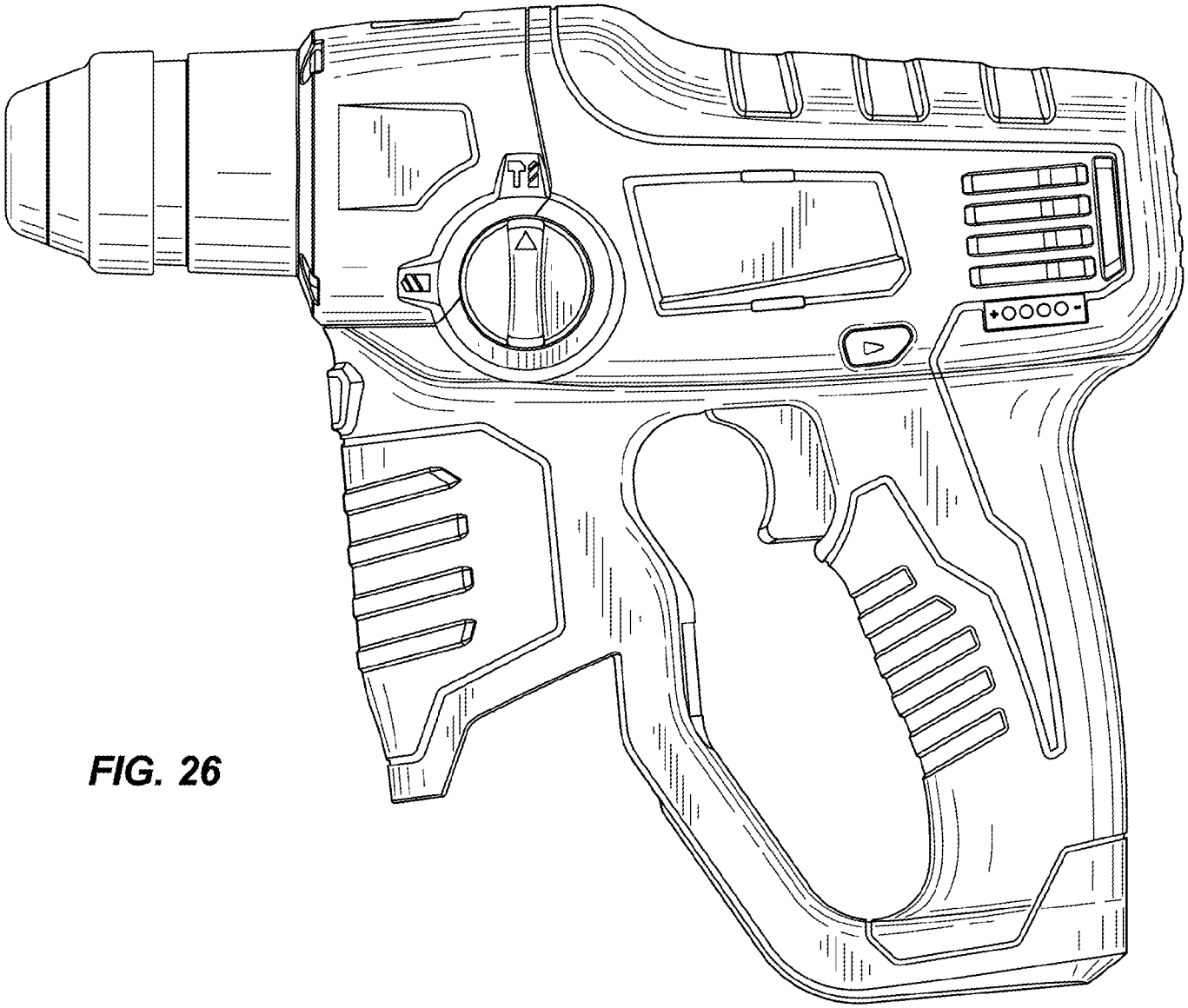
FIG. 26 is a right side view of the rotary hammer of FIG. 25.
Figure 27:
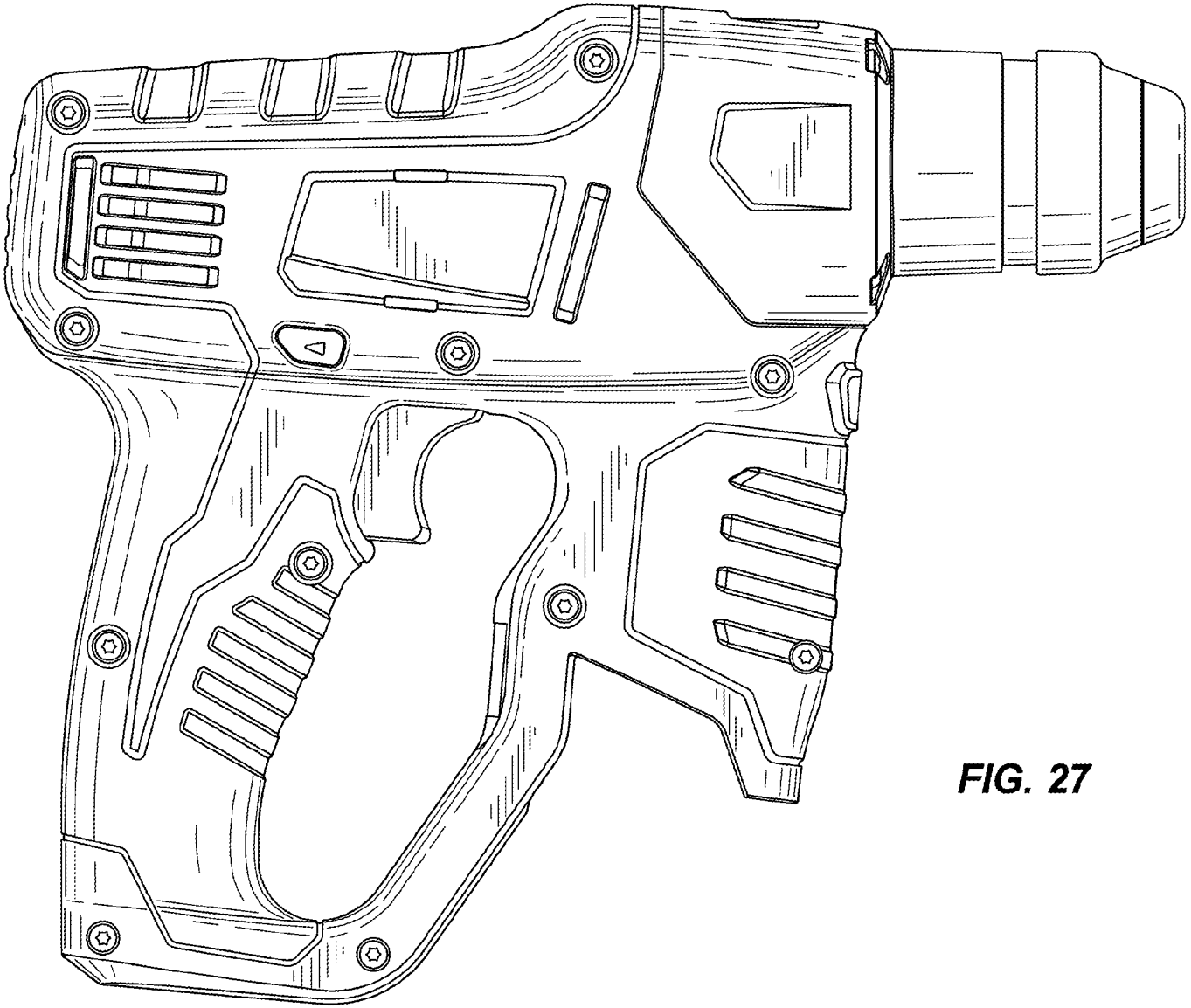
FIG. 27 is a left side view of the rotary hammer of FIG. 25.
Figure 28:
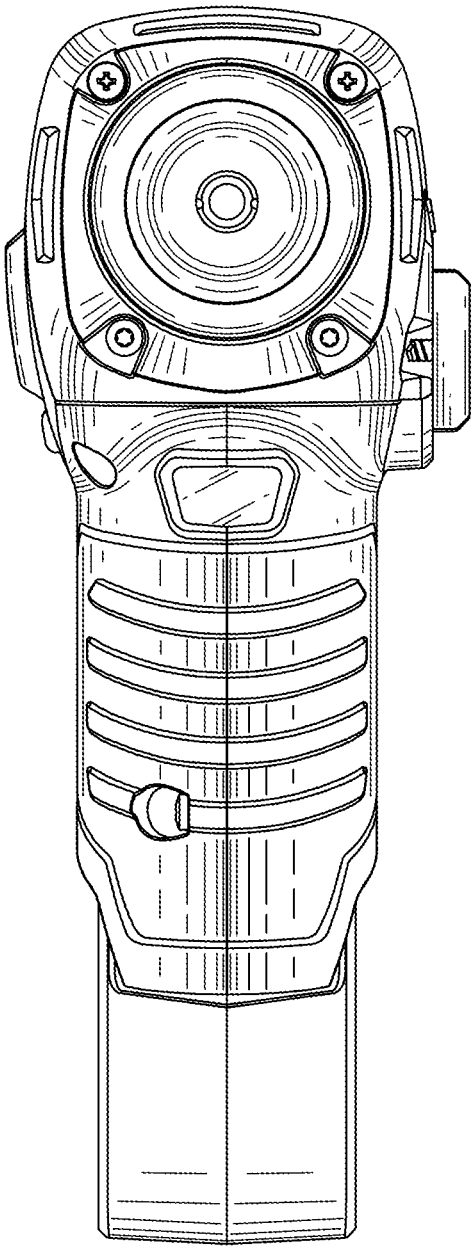
FIG. 28 is a front view of the rotary hammer of FIG. 25.
Figure 29:
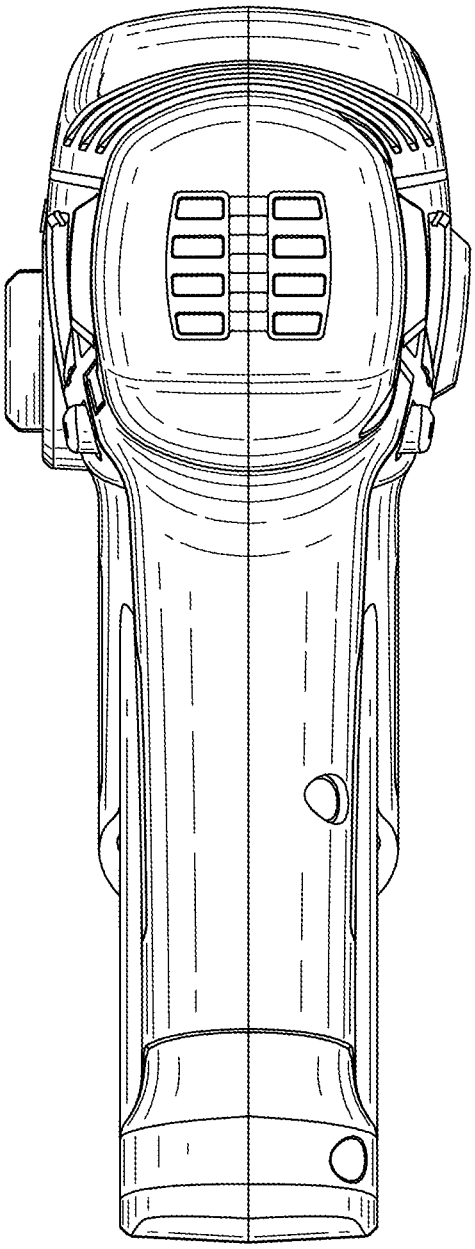
FIG. 29 is a rear view of the rotary hammer of FIG. 25.
Figure 30:
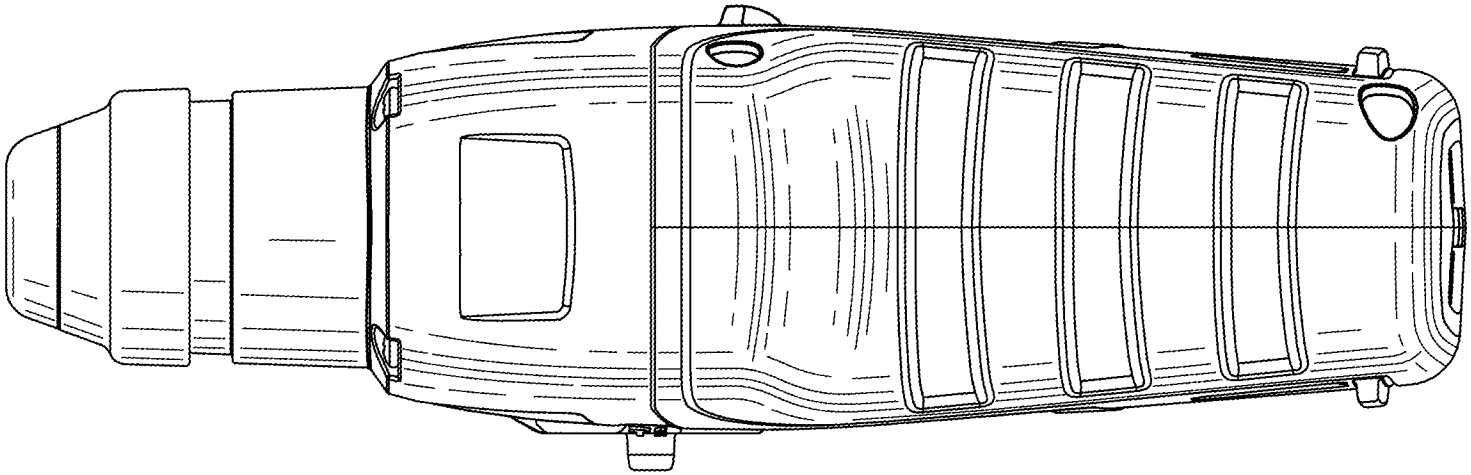
FIG. 30 is a top view of the rotary hammer of FIG. 25.
Figure 31:
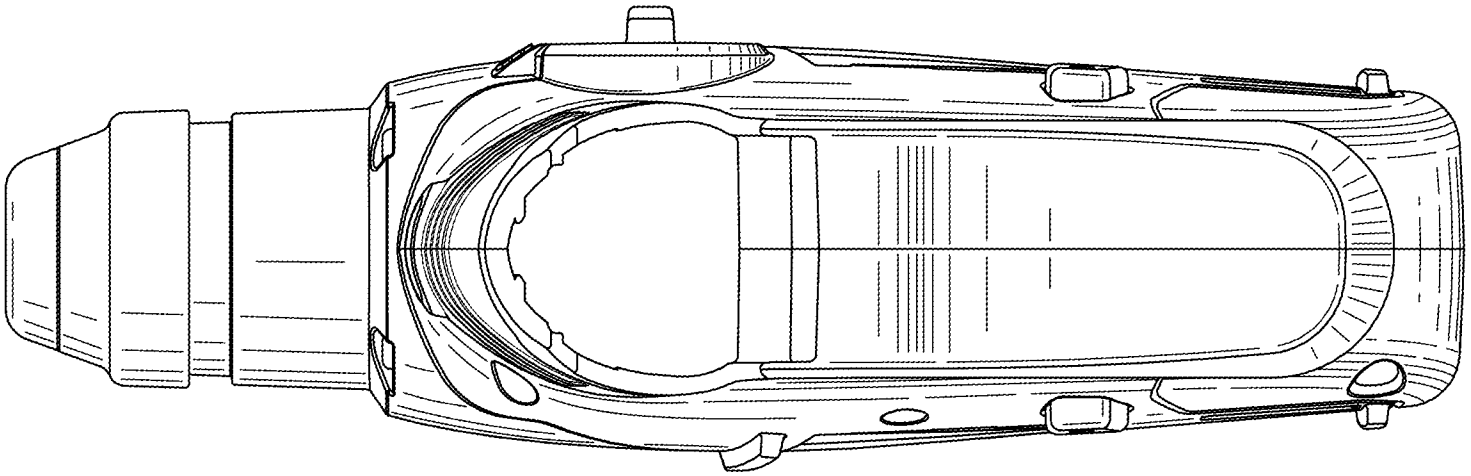
FIG. 31 is a bottom view of the rotary hammer of FIG. 25.

With reference to FIGS. 2, 9, and 10 the rotary hammer 10 includes a mode selection mechanism 122 having a shift fork 126 operable to move the coupler 110 along the non-cylindrical portion 114 of the intermediate shaft 54 between a first position (FIG. 10), in which the coupler 110 is disengaged from the wobble assembly 102, and a second position (FIG. 9), in which the coupler 110 is engaged with the wobble assembly 102. The coupler 110 includes a circumferential groove 130 in which respective prongs 134 of the shift fork 126 are received (FIG. 2). As such, the prongs 134 remain within the groove 130 as the coupler 110 is rotated with the intermediate shaft 54.

With reference to FIGS. 1 and 2, the mode selection mechanism 122 also includes a mode selection actuator 138 that is accessible by an operator of the hammer 10 to switch the rotary hammer 10 between a "drill" mode, in which the impact mechanism 82 is deactivated (FIG. 10), and a "hammer-drill" mode, in which the impact mechanism 82 is activated (FIG. 9). In the illustrated construction of the rotary hammer 10, the mode selection actuator 138 is configured as a knob 142 having an offset cam member 146 (FIG. 2) that is engageable with the shift fork 126 to move the shift fork 126 between first and second positions corresponding with the drill mode and the hammer-drill mode of the rotary hammer 10, respectively. Alternatively, any of a number of different actuators 138 may be employed to toggle the shift fork 126 between the first and second positions.

The shift fork 126 is supported within the housing 14 by a shaft 150, and a biasing member (e.g., a compression spring 154) is positioned coaxially with the shaft 150 for biasing the shift fork 126 toward the second position coinciding with the hammer-drill mode of the rotary hammer 10. When the coupler 110 is moved to the first position by the shift fork 126 against the bias of the spring 154 (FIG. 10), respective teeth 158, 162 on the coupler 110 and the wobble assembly 102 are disengaged. As such, torque from the intermediate shaft 54 is not transferred to the wobble assembly 102 to reciprocate the piston 86. When the coupler 110 is moved to the second position by the shift fork 126 and the spring 154 (FIG. 9), the respective teeth 158, 162 on the coupler 110 and the wobble assembly 102 are engaged to transfer torque from the intermediate shaft 54 to the wobble assembly 102 (i.e., via the coupler 110). As such, the wobble assembly 102 may reciprocate the piston 86 in the hammer-drill mode of the rotary hammer 10.

Figure 4:
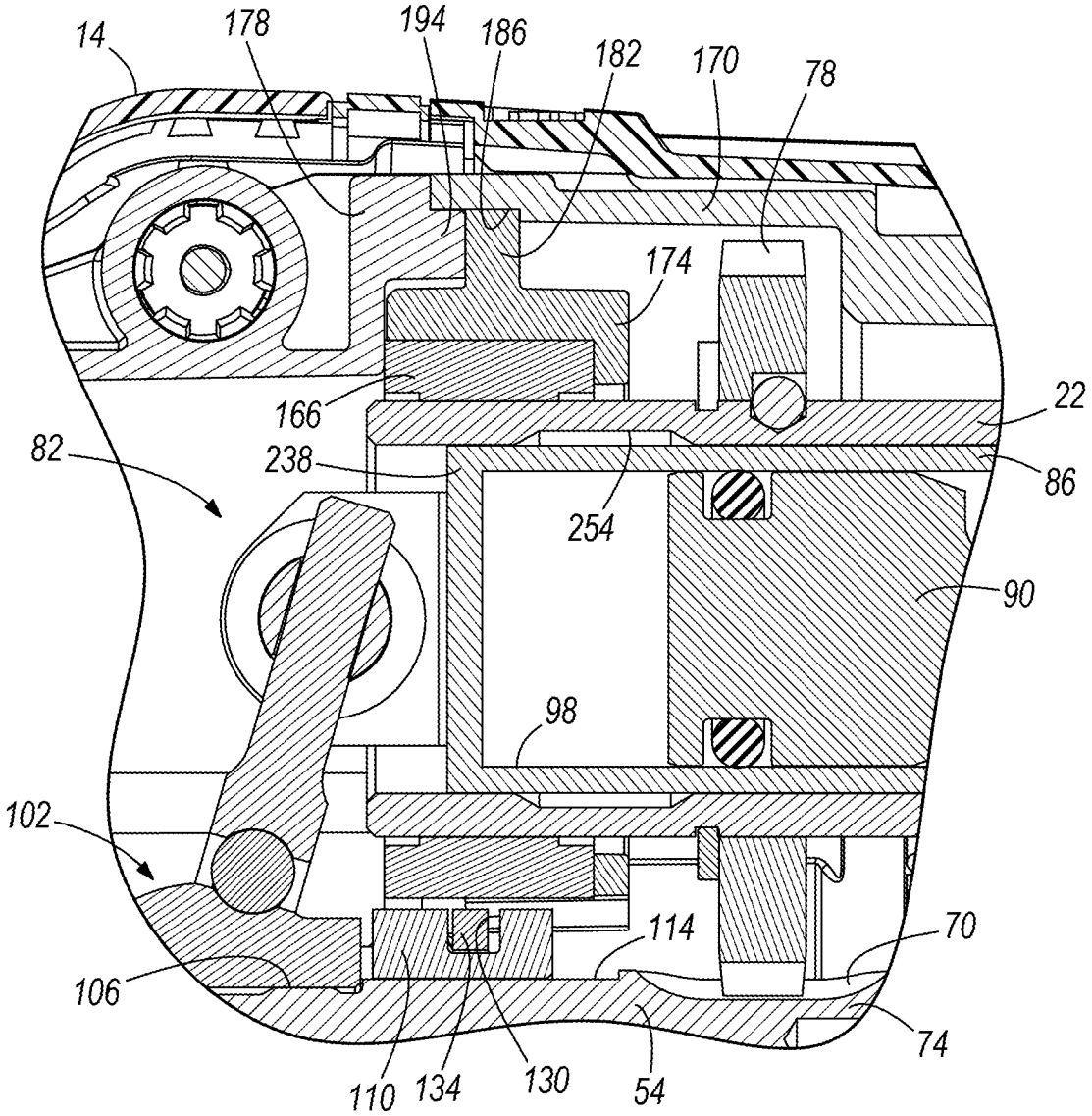
FIG. 4 is an enlarged view of a portion of the rotary hammer shown in FIG. 3.

With reference to FIGS. 2-4, the rotary hammer 10 includes a radial bearing 166 that supports a rear end of the spindle 22 within a front gear case 170. As used herein, "radial bearing" refers to both non-roller bearings (i.e., bushings) and roller bearings (e.g., ball or cylindrical roller bearings, etc.). The rotary hammer 10 also includes a bearing holder 174 that axially constrains the radial bearing 166 against a rear gear case 178. The bearing holder 174 includes a radially extending flange 182 that is trapped between the front and rear gear cases 170, 178 (FIG. 4). The front gear case 170 also includes an internal locating surface 186 adjacent an open end of the front gear case 170 to which the bearing holder 174 and the rear gear case 178 are both registered (i.e., brought into axial alignment with a longitudinal axis 190 of the front gear case; FIG. 2). Particularly, the rear gear case 178 includes an axially extending flange 194 (FIG. 2) that is received within the front gear case 170 and that is engaged with the internal locating surface 186 (FIG. 4). As shown in FIG. 2, the front and rear gear cases 170, 178 are secured together by fasteners 198, and enclose therein the impact mechanism 82 and portions of the mode selection mechanism 122.

With continued reference to FIG. 2, the knob 142 of the mode selection mechanism 122 is trapped between the front and rear gear cases 170, 178. Particularly, the front gear case 170 includes a first semi-circular recess 200 in which one-half of the knob 142 is positioned, and the rear gear case 178 includes a second semi-circular recess 201 in which the remaining one-half of the knob 142 is positioned. When the front and rear gear cases 170, 178 are secured together, the shape of the respective recesses 200, 201 inhibits the knob 142 from being axially removed from the gear cases 170, 178, yet permits rotation of the knob 142 relative to the gear cases 170, 178 to switch the rotary hammer 10 between the "drill" mode and the "hammer-drill" mode.

Figure 5:
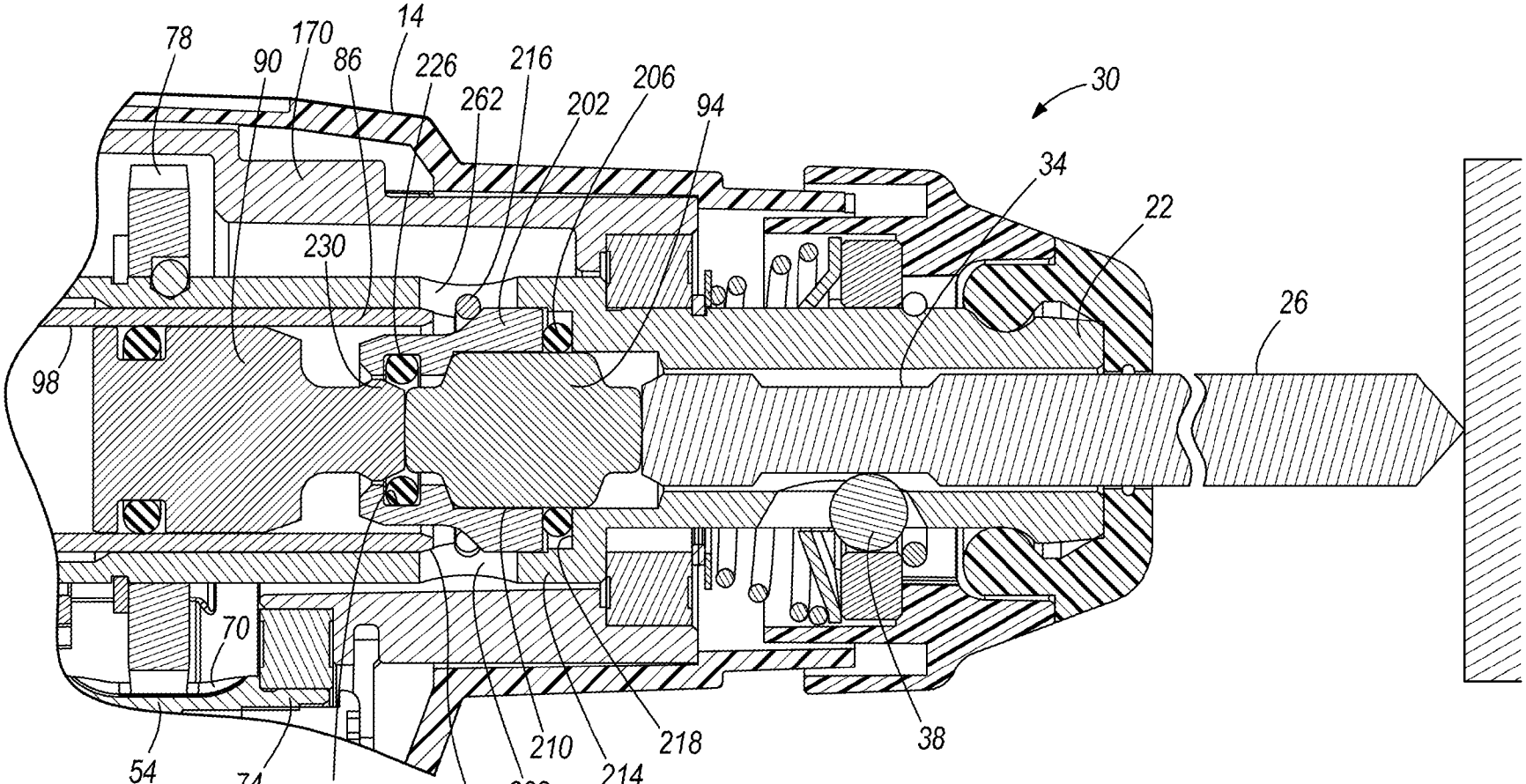
FIG. 5 is an enlarged view of a portion of the rotary hammer shown in FIG. 3, illustrating the rotary hammer in a "hammer" mode.
Figure 6:
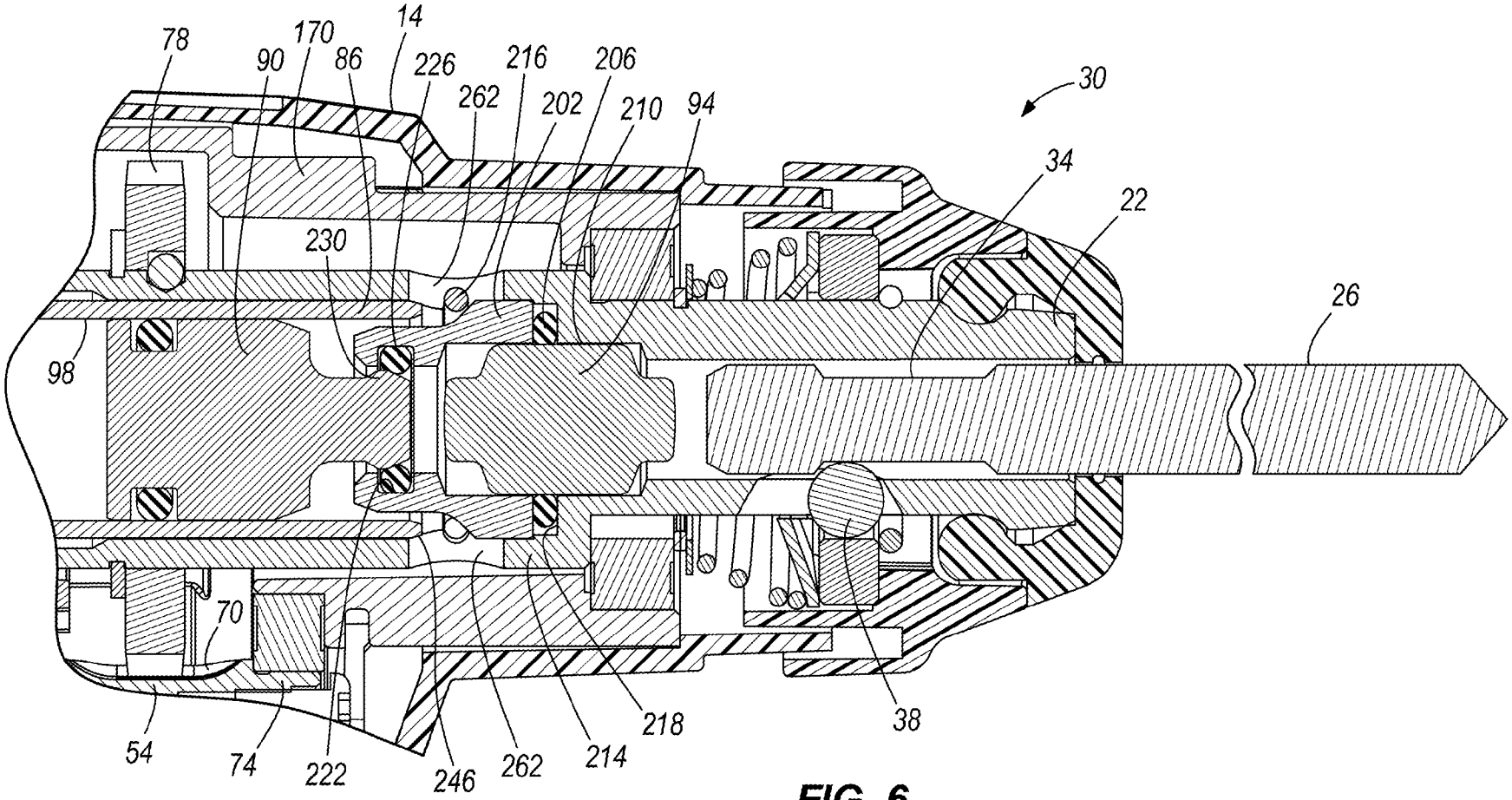
FIG. 6 is an enlarged view of a portion of the rotary hammer shown in FIG. 3, illustrating the rotary hammer in an "idle" mode.

With reference to FIGS. 3, 5, and 6, the impact mechanism 82 further includes a retainer 202 for securing the striker 90 in an "idle" position (shown in FIG. 8) in which it is inhibited from reciprocating within the piston 86. With reference to FIGS. 3, 5, and 6, an O-ring 206 is positioned between the retainer 202 and the spindle 22, and disposed around an outer peripheral surface 210 of the anvil 94. Particularly, the spindle 22 includes a step 214 defining an interior annular surface 218 (FIGS. 5 and 6), and the O-ring 206 is positioned between the retainer 202 and the annular surface 218 of the spindle 22. An internal snap ring 216 defines a rearward extent to which the retainer 202 is movable from the frame of reference of FIG. 5. In this position of the retainer 202, in the illustrated construction of the rotary hammer 10, a light preload is applied to the O-ring 206.

The retainer 202 includes a circumferential groove 222 in an inner peripheral surface of the retainer 202 and an O-ring 226 positioned within the circumferential groove 222. The O-ring 226 defines an inner diameter, and the striker 90 includes a nose portion 230 defining an outer diameter greater than the inner diameter of the O-ring 226. As such, the nose portion 230 of the striker 90 is engageable with the O-ring 226 in the retainer 202 when assuming the idle position as described in more detail below and shown in FIG. 8.

When the tool bit 26 of the rotary hammer 10 is depressed against a workpiece, the tool bit 26 pushes the striker 90 (via the anvil 94) rearward toward an "impact" position, shown in FIG. 5. During operation of the rotary hammer 10 in the hammer-drill mode, the piston 86 reciprocates within the spindle 22 to draw the striker 90 rearward and then accelerate it towards the anvil 94 for impact. When the tool bit 26 is removed from the workpiece, the rotary hammer 10 may transition from the hammer-drill mode to an "idle" mode, in which the striker 90 is captured by the retainer 202 in the idle position shown in FIG. 8 and prevented from further reciprocation within the piston 86. Prior to being captured in the idle position, the striker 90 impacts the retainer 202 to displace the retainer 202 from a first position (FIG. 5), in which a light preload is applied to the O-ring 206, and a second position (FIG. 6), in which a compressive load is applied to the O-ring 206 greater than the preload. The inner diameter of the O-ring 206 is reduced as a result of being compressed. The compression of the O-ring 206 imparts a frictional force on the outer peripheral surface 210 of the anvil 94, thereby decelerating or "parking" the anvil 94 within the spindle 22. As such, transient movement of the anvil 94 upon the rotary hammer 10 transitioning from the hammer-drill mode to the idle mode is reduced.

Figure 7:
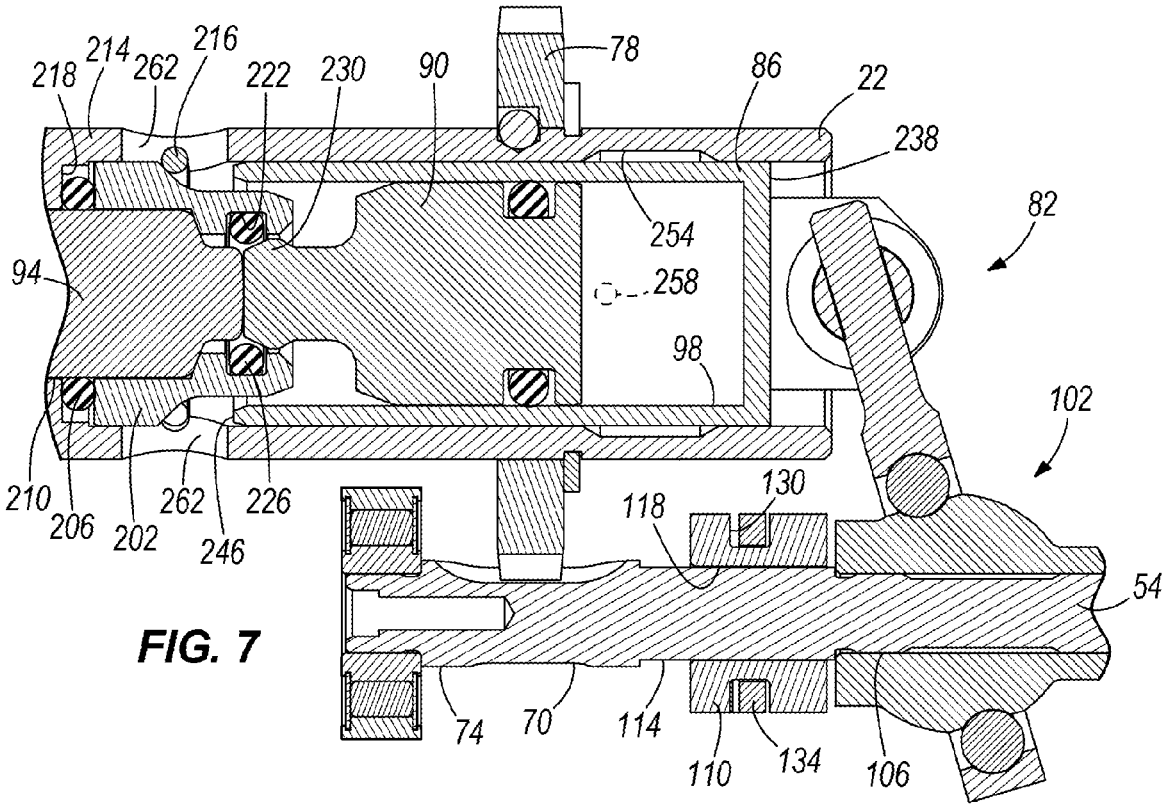
FIG. 7 is an enlarged view of a portion of the rotary hammer shown in FIG. 3, illustrating the rotary hammer in the "hammer" mode.
Figure 8:
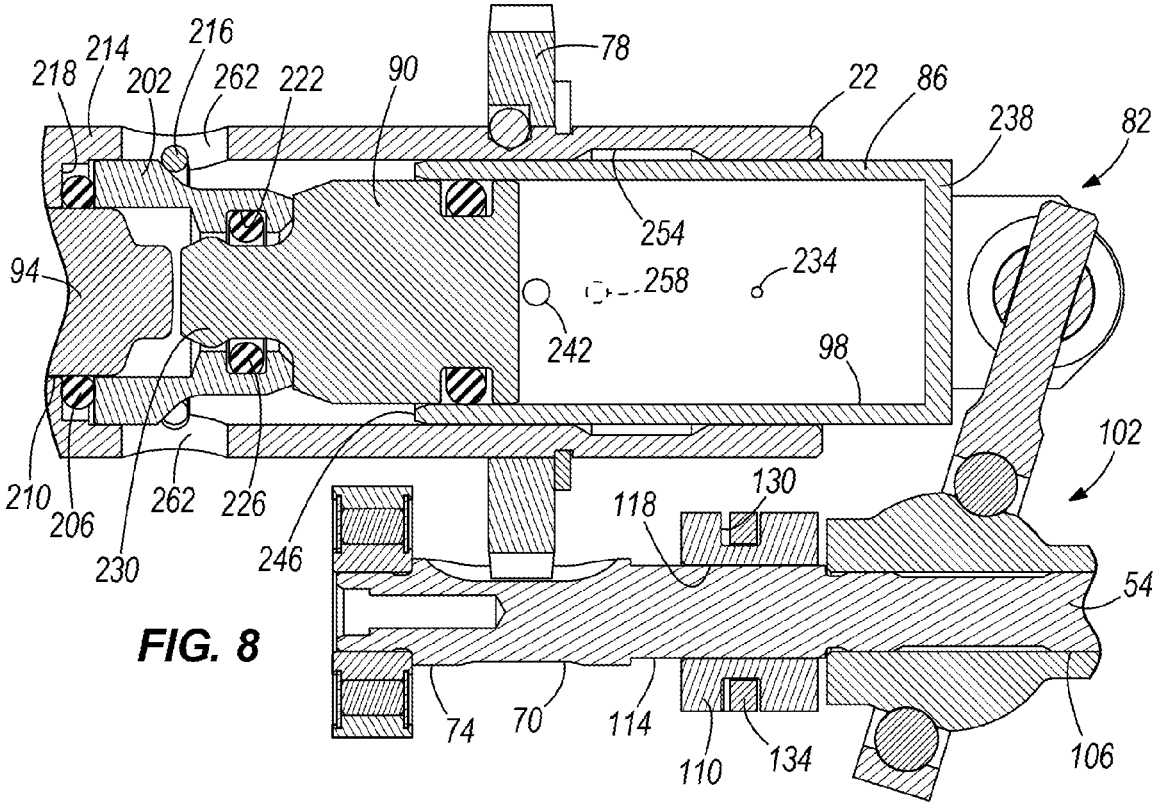
FIG. 8 is an enlarged view of a portion of the rotary hammer shown in FIG. 3, illustrating the rotary hammer in the "idle" mode.

With reference to FIG. 8, the piston 86 includes an orifice 234 disposed proximate a rear, closed end 238 of the piston 86 and an idle port 242 disposed proximate a front, open end 246 of the piston 86. The piston 86 also includes a notch 250 (FIG. 2) formed in the outer periphery of the piston 86 adjacent the front open end 246. The idle port 242 coincides with the notch 250. The spindle 22 includes an annular groove 254 formed in the inner periphery of the spindle 22 (FIGS. 7 and 8) and a vent port 258 positioned in the groove 254 (see also FIG. 2). The spindle 22 further includes additional vent ports 262 that fluidly communicate the interior of the spindle 22 with the atmosphere.

As mentioned above, when the tool bit 26 of the rotary hammer 10 is depressed against a workpiece, the tool bit 26 pushes the striker 90 (via the anvil 94) rearward toward the "impact" position (shown in FIG. 7) in which the idle port 242 in the piston 86 is blocked by the striker 90, thereby forming the air pocket between the striker 90 and the reciprocating piston 86. As operation of the rotary hammer 10 initially commences (i.e., within one second or less after the rotary hammer 10 is initially activated), the orifice 234 in the piston 86 may remain uncovered by the striker 90 for brief intervals while the orifice 234 is aligned with the annular groove 254. During these intervals, air may be drawn into the interior chamber 98 of the piston 86 or expelled from the interior chamber 98, depending upon the air pressure within the interior chamber 98 just prior to activation of the rotary hammer 10, to allow the air pocket to achieve "steady state" in which an approximately constant air mass produces an approximately constant cyclical force on the striker 90.

During steady-state operation of the rotary hammer 10 in the hammer-drill mode, the piston 86 reciprocates within the spindle 22 to draw the striker 90 rearward and then accelerate it towards the anvil 94 for impact. The movement of the striker 90 within the piston 86 is such that the orifice 234 is blocked by the striker 90 while the orifice 234 is aligned with the annular groove 254 in the spindle 22, thereby maintaining the existence of the air pocket. At any instance when the orifice 234 is unblocked by the striker 90, the orifice 234 is misaligned with the annular groove 254, thereby preventing escape of the air from the interior chamber 98 of the piston 86 and maintaining the existence of the air pocket.

When the tool bit 26 is removed from the workpiece, the rotary hammer 10 may transition from the hammer-drill mode to the idle mode, in which the striker 90 is captured in the position shown in FIG. 8 and prevented from further reciprocation within the piston 86. During the transition from hammer-drill mode to idle mode, the air pocket established between the piston 86 and the striker 90 is de-pressurized in a staged manner as the orifice 234 in the piston 86 is aligned with the annular groove 254, thereby permitting pressurized air within the piston 86 to vent through the orifice 234 and the vent port 258 in the annular groove 254 of the spindle 22. When the piston 86 reaches the position shown in FIG. 8, the idle port 242 is uncovered, thereby permitting the remainder of the pressurized air within the piston 86 to vent through the idle port 242, through the space defined between the notch 250 and the spindle 22, and through the additional vent ports 262 in the spindle 22 to atmosphere. Continued reciprocation of the piston 86 is therefore permitted without drawing the striker 90 back to the impact position shown in FIG. 7 because the orifice 234 remains unblocked when it is aligned with the annular groove 254 in the spindle 22. Rather, air is alternately drawn and expelled through the orifice 234 and the idle port 242 while the piston 86 reciprocates. Depressing the tool bit 26 against the workpiece to push the anvil 94 and the striker 90 rearward (i.e., to the position shown in FIG. 7) causes the rotary hammer 10 to transition back to the hammer-drill mode.

Various features of the invention are set forth in the following claims.

What is claimed is:

1. A rotary hammer adapted to impart axial impacts to a tool bit, the rotary hammer comprising:

a motor;

a spindle coupled to the motor for receiving torque from the motor;

a radial bearing that rotatably supports the spindle;

a front gear case in which the spindle is at least partially received;

a rear gear case coupled to the front gear case;

a bearing holder axially constraining the radial bearing against one of the front gear case and the rear gear case; and an internal locating surface defined on the other of the front gear case and the rear gear case to which the bearing holder and the one of the front gear case and the rear gear case are registered.

2. The rotary hammer of claim 1, wherein the radial bearing is axially constrained against the rear gear case by the bearing holder.

3. The rotary hammer of claim 1, wherein the internal locating surface is defined on the front gear case.

4. The rotary hammer of claim 3, wherein the internal locating surface is positioned adjacent an open end of the front gear case.

5. The rotary hammer of claim 3, wherein the rear gear case includes an axially extending flange at least partially received within the front gear case, and wherein the axially extending flange is engaged with the internal locating surface.

6. The rotary hammer of claim 1, wherein the bearing holder includes a radially extending flange trapped between the front and rear gear cases.

7. The rotary hammer of claim 6, wherein the radially extending flange is engaged with the internal locating surface.

8. The rotary hammer of claim 1, wherein the front gear case defines a longitudinal axis coaxial with the spindle, and wherein the bearing holder and the rear gear case are brought into axial alignment with the longitudinal axis by the internal locating surface.

9. The rotary hammer of claim 1, further comprising:

a piston at least partially received within the spindle for reciprocation therein;

a striker received within the spindle for reciprocation in response to reciprocation of the piston; and an anvil received within the spindle and positioned between the striker and the tool bit, the anvil imparting axial impacts to the tool bit in response to reciprocation of the striker.

10. The rotary hammer of claim 9, wherein the piston includes an interior chamber, and wherein the striker is at least partially received within the interior chamber.

11. The rotary hammer of claim 10, further comprising an air pocket positioned between the piston and the striker, wherein expansion and contraction of the air pocket induces reciprocation of the striker.

* * * * *